US005322424A

United States Patent [19]

Fujio

[11] Patent Number: 5,322,424

[45] Date of Patent: Jun. 21, 1994

[54] TWO STAGE GAS COMPRESSOR

[75] Inventor: Katuhara Fujio, Koga, Japan

[73] Assignee: Matsushita Electric Industrial Co., Ltd., Osaka, Japan

[21] Appl. No.: 87,765

[22] PCT Filed: Nov. 10, 1992

[86] PCT No.: PCT/JP92/01458

§ 371 Date: Jul. 9, 1993

§ 102(e) Date: Jul. 9, 1993

[87] PCT Pub. No.: WO93/10356

PCT Pub. Date: May 27, 1993

[30] Foreign Application Priority Data

Nov. 12, 1991 [JP] Japan ..... 3-295515

[51] Int. Cl.[5] ..... F01L 1/30

[52] U.S. Cl. ..... 418/11; 418/60; 418/212

[58] Field of Search ..... 418/11, 60, 63, 212, 418/248

[56] References Cited

U.S. PATENT DOCUMENTS 4,726,739 2/1988 Saitou et al. ..... 418/60
5,242,280 9/1993 Fujio ..... 418/11

FOREIGN PATENT DOCUMENTS 50-72205 6/1975 Japan .
60-128990 7/1985 Japan .
62-218680 9/1987 Japan .
63-83483 6/1988 Japan .
1-247785 10/1989 Japan .

*Primary Examiner*—Richard A. Bertsch
*Assistant Examiner*—Charles Freay
*Attorney, Agent, or Firm*—Spencer, Frank & Schneider

[57] ABSTRACT

A motor and a low and a high pressure stage compression element which are driven by the motor are disposed in a closed container so as to constitute a rolling piston type rotary compression mechanism in which the discharge side of the low pressure stage compression element is communicated with the suction side of the high pressure stage compression element by way of a communication passage, and coolant compressed by said high pressure stage compression element is discharged into the closed container so as to define a discharge gas passage for cooling the motor, and the cylinder volume of the high pressure stage compression element is set to 45 to 65% of that of said low pressure stage compression element while the compression timing of the high pressure stage compression element is delayed by an angle of 60 to 80 deg. from the compression timing of the low pressure stage compression element so as to optimize the compression timings of the high and low pressure stage compression elements in order to reduce excessive compression and insufficient compression, thereby it is possible to aim at enhancing the compression efficiency.

1 Claim, 23 Drawing Sheets

TWO STAGE GAS COMPRESSOR

TECHNICAL FIELD

The present invention relates to a coolant compressor incorporating a two stage compressing function, and in particular to an enhancement in compression efficiency by improving the compression timing between a low stage compression element and a high stage compression element.

These years, in the field of refrigerators, studies for materializing a coolant compressor which is suitable for high compression ratio operation, as a part of insurance of a low temperature heat source and a high temperature heat source, have been prosperous.

Particularly, several kinds of multi-stage rotary type compressors have been proposed in order to enhance the compression efficiency by decreasing the pressure differential between a compression chamber and a suction chamber so as to reduce the volume of leakage gas under compression (Japanese Patent Unexamined Publication No. 50-72205).

Specifically, a rolling type rotary two stage compressor and a two stage compression/two stage expansion refrigerating cycle system configuration connected thereto with the former compressor has been proposed as shown in FIGS. 11 to 13 (Japanese Patent Unexamined Publication No. 50-72205).

In these figures, a drive motor 1005 is disposed in the upper part of a closed container 1003 while a compression mechanism coupled to a rotary shaft 1005*c* of the drive motor 1005 and composed of two upper and lower stages (a low pressure stage compression mechanism 1007 as the upper stage and a high pressure stage compression mechanism 1009 as the lower stage) is disposed in the lower part of the closed container, and an oil sump is disposed in the bottom part thereof, the back surface of a vane 1007*c* (1009*c*) which partitions each of cylinders of the low pressure stage compression mechanism 1007 and the high pressure stage compression mechanism 1009 into a suction chamber and a compression chamber being communicated with the internal space of the closed container 1003, and a back pressure urging force applied to the vane 1007*c* (1009*c*) being given by a reaction force of a spring device and a pressure in the closed container 1003.

Coolant gas discharged from the lower pressure stage compression mechanism 107 flows into an external gas-liquid separator 1017 through a discharge pipe 1007*e*, and then again flows into the internal space of the closed container 1003 through a communication pipe 1009*d'* so as to cool the motor 1005.

Discharged coolant gas having flown again into the closed container 1003 sucks up lubrication oil in the bottom part of the closed container 1003 when it flows through a suction pipe 1009*d* connected thereto with an oil suction pipe 1023 in order that the lubrication oil is used for cooling a slide surface and for sealing a gap in the compression chamber.

Discharged coolant gas recompressed by the high pressure stage compression mechanism 1009 is fed into an external condenser 1013 through a discharge pipe 1009*e*, and then returns again into the low pressure stage compression mechanism 1007 through a suction pipe 1007*d* by way of a first expansion valve 1015, the gas-liquid separator 1017, a second expansion valve 1019 and an evaporator 1021.

Further, in order to improve torque variation which is large during compression and which is one of disadvantages inherent to the rolling piston type rotary two stage compressor, the directions of eccentricity of crank parts of the rotary shaft 1005*c* are shifted from each other by an angle of 180 deg., and the directions of attachment of the vanes (1007*c*, 1009*c*) of both compression mechanisms (low pressure stage compression mechanism 1007 and high pressure stage compression mechanism 1009) are shifted between the high and low pressure stage sides by an angle of 75 to 80 deg, as will be explained hereinbelow although it is not shown in the drawings showing this example. That is, a countermeasure for reducing the torque variation in comparison with a rotary type first stage compressor has been proposed.

The two stage compression refrigerating cycle is constituted by the arrangement of the above-mentioned components so as to devise the measure for holding the pressure of the internal space of the closed container 1003 at a value intermediate between the condensation pressure and evaporation pressure of the coolant.

However, in the above-mentioned arrangement as shown in FIGS. 1 to 3, coolant gas flowing into the suction side of the high pressure stage compression mechanism 1009 is heated when it passes around the drive motor 1005, and accordingly, there has been raised such problems that the suction efficiency of the coolant gas is lowered in the high pressure stage compression mechanism 1009, and the compression efficiency is remarkably lowered due to an abnormal rise in pressure of the coolant gas during compression.

Further, such a proposed arrangement that, as mentioned above, the directions of eccentricity of the crank parts are shifted from each other by an angle of 180 deg. and the directions of attachment of the vanes (1007*c* and 1009*c*) of both compression mechanisms (the low pressure stage compression mechanism 1007 and the high pressure stage compression mechanism 1009) are shifted from each other by an angle of 75 to 80 deg. between the high stage and the low stage, must take two kinds of configurations as understood from explanatory models of compression element configurations shown in FIGS. 4 and 5.

That is, in FIG. 4, the compression timing of the high pressure stage compression mechanism 1009 as shown in FIG. 1 is delayed from that of the low pressure stage compression mechanism 1009 by an angle of 100 to 105 deg.

Further, in FIG. 5, the compression timing of the high compression mechanism 1009 shown in FIG. 11 is advanced by an angle of 100 to 105 deg.

However, those arrangement having the above-mentioned compression timings do not always fully satisfy optimum conditions which will be explained hereinbelow, in view of the reduction of compression input and the reduction of vibration and noise.

That is, FIG. 6 is an explanatory view showing the discharge volume and discharge timing of gas from the low pressure stage compression mechanism 1007, the suction volume and suction timing of the high pressure stage compression mechanism 1009 as shown in FIG. 1, and excessive and insufficient conditions of the volume of discharge gas from the low pressure stage compression mechanism 1007, which are obtained when, for example, the cylinder volume of the high pressure stage compression mechanism 1009 is set to 45 to 65%

($V_2/V_1$=0.45 to 0.65) as shown in FIG. 1, and which are based upon the compression time shown in FIG. 14.

Further, FIG. 7 is an explanatory view showing the discharge volume and discharge timing of gas from the low pressure stage compression mechanism 1007, the suction volume and suction timing of the high pressure stage compression mechanism 1009 as shown in FIG. 1, and excessive and insufficient conditions of gas from the low pressure stage compression mechanism 1007, which are obtained when, for example, the cylinder volume of the high pressure stage compression mechanism 1009 is set to 45 to 65% ($V_2/V_1$=0.45 to 0.65), and which are based upon the compression timing shown in FIG. 15.

In both explanatory views as mentioned above, excessive discharge volume ranges ($v_1$, $v_2$) exhibit compression timings and excessive gas volumes in a condition such that the volume of coolant gas which is discharged per unit time from the low pressure stage compression mechanism 1007 is in excess of the suction volume of the high pressure stage compression mechanism per unit time. Further, insufficient discharge volume ranges ($v_3$, $v_4$, $v_5$, $v_6$) exhibit compression timings and insufficient gas volumes in a condition such that the volume of coolant gas which is discharged per unit time from the low pressure stage compression mechanism 1007 is insufficient in comparison with the suction volume of the high pressure stage compression mechanism 1009.

As well-known, the final suction volume of the high compression mechanism 1009 of the two stage compressor is set to be equal to the total volume of coolant gas discharged from the low pressure stage compression mechanism 1009. However, in the excessive discharge volume ranges (($v_1$, $v_2$) during the transition between the discharge stroke and the suction stroke, the pressure in a space (intermediate passage) between the discharge side of the low pressure stage compression mechanism 1007 and the suction side of the high pressure stage compression mechanism 1008 becomes higher so as to incur an increase in input on the low pressure stage compression mechanism 1009. Further, in the insufficient discharge volume ranges ($v_3$, $v_4$, $v_5$, $v_6$), coolant gas is sucked into the high pressure stage compression mechanism 1009 while the latter is replenished with excessive discharge gas produced in the excessive discharge ranges ($v_1$, $v_2$), but the suction gas causes a delay in follow-up, resulting in instant decrease in suction pressure.

As a result, remarkable fluctuation is caused in the pressure of coolant gas in the intermediate passage, and accordingly, vibration and noise occur. Further, the compression ratio of the high pressure stage compression mechanism 1009 becomes higher due to cyclic increase and decrease in the pressure of the intermediate passage, that is, there is presented a basic problem in that the compression efficiency is lowered.

In view of this view point, as a result of consideration made to the degrees of the excessive discharge volume ranges ($v_1$, $v_2$) shown in FIGS. 6 and 7, it can be hardly said that both ranges do not give an optimum compression ratio. In particular, with a refrigerating device in which the internal volume of the intermediate passage is small, vibration and noise, and affection upon the compression ratio are large since the pulsation and the rise of pressure in the intermediate passage is large, that is, this causes a serious problem.

Japanese Laid-Open Patent No. 1-247785 proposes a means which improves such a problem relating to the compression timings of both compression mechanisms, as shown in FIGS. 8 and 9.

FIG. 8 is an explanatory view showing the compression timings of a low pressure stage compression mechanism 2005 and a high pressure stage compression mechanism 2006 of a two stage compressor, and FIG. 9 is a partial transverse-sectional view illustrating the compressor comprising the low pressure stage compression mechanism 2005 disposed in a vertical type closed casing 2001 and a valve cover 2027 therefor, a high pressure stage compression mechanism 2006 disposed below the low pressure stage compression mechanism 2005 and a valve cover 2028 therefor, an intermediate frame 2020 connecting between both compression mechanisms 2005 and 2006, a crank shaft 2004 for driving both compression mechanisms 2005, 2006, a passage 2023 connecting the discharge side of the low pressure stage compression mechanism 2005 and the suction side of the high pressure stage compression mechanism 2006, and the like with 2011 and 2012 being arranged so as to be spaced from each other by an angle of 90 deg. so as to delay the compression timing of the high pressure stage compression mechanism 2006 from that of the low pressure stage compression mechanism 2005 by an angle of 90 deg. and pressure gas discharged from the high pressure stage compression mechanism 2006 is filled in the vertical closed casing 1001.

The drive effect which is obtained by delaying the compression timing of the high pressure stage compression mechanism from the low pressure stage compression mechanism by an angle of 90 deg. was confirmed with the use of a similar compression test compressor, and was found such that coolant gas discharged from the low pressure stage compression mechanism does not flow around a motor (which is not shown) in the process of flowing into the suction side of the high pressure stage compression mechanism, and accordingly, no heat is absorbed from the motor, thereby it is possible to obtain a high compression efficiency.

FIG. 10 is an explanatory view showing excessive and insufficient conditions of the volume of gas discharged from the low pressure stage compression mechanism in accordance with a volume and discharge gas from and a discharge timing of the low pressure stage compression mechanism, and a suction volume and a suction timing of the high pressure stage compression mechanism when the cylinder volume of the high pressure stage compression mechanism of the test compression is set to 45 to 65% ($V_2/V_1$=0.45 to 65) of that of the low pressure stage compression mechanism. An excessive discharge volume range ($v_3$) in this figure becomes less than the excessive discharge volume ranges ($v_1$, $v_2$) shown in FIGS. 6 and 7. This fact is coincident with that the efficiency of the above-mentioned test compressor was high.

It is noted that FIGS. 11 through 13 show results of examination for pressure variations in various parts in the test compressor in order to find out measures for further enhancing the compression efficiency of the two stage compressor.

That is, referring to FIG. 11, the abscissa exhibits crank angles and the ordinate exhibits pressures in various parts, that is, the pressure conditions of various parts are arranged in the order of successively ascending upward from the low stage, along the stream of coolant gas.

FIG. 12 shows the process of variation in coolant gas if the pressures of the various parts in FIG. 11 are successively connected one another.

FIG. 13 shows a range of an excessively compressed part in the low stage compression chamber by extracting a pressure of the low stage compression chamber alone in FIG. 11.

Next, explanation will be made of the pressure variations in various parts shown in FIG. 12 in order to precisely understand the serious problems of the two stage compressor.

That is, the pressure variation in a passage downstream of an accumulator indicates that the excessive sucking action (the gas pressure in the suction pipe gives a pulsation phenomenon, following the sucking action of the compressor, and gas at the time of cyclic pressure rising flows into the suction chamber and is compressed in this condition so as to increase the compression mechanism) of the accumulator (which is connected to the low pressure stage compression mechanism by a pipe line so as to have both gas-liquid separating function and liquid accumulating function in order to normally prevent occurrence of liquid compression caused by unevaporated liquid coolant flowing into the compression chamber) is large.

Further, it is of course ideal that the pressure variation in the intermediate passage becomes zero, but it is impossible unless the internal volume of the intermediate passage becomes indefinite. This test compressor has a small size, and accordingly the pressure variation is abnormally large. Further, in view of the timing of maximum pressure drop during the period of the variation, it is found that pressure variation in the intermediate passage follows up the suction stroke of the high pressure stage compression mechanism.

Further, the pressure variations in the low stage discharge chamber follows up the pressure variations in the intermediate passage, and is in association with the discharge timing of coolant gas from the low stage compression chamber.

Further, the optimum compression timing of the low stage compression chamber is in advance of the maximum pressure drop of the low stage discharge chamber by an angle of 10 to 20 deg.

As clear from the pressure variations in the compressor, shown in FIGS. 11 through 13, in the two stage compressor having such an arrangement that the compression timing of the high pressure stage compression mechanism is delayed from that of the low pressure stage compression mechanism by an angle of 90 deg, the most excessive compression timing of the pressure in the compression chamber of the low pressure stage compression mechanism is not coincident with the maximum pressure drop timing of the low stage discharge chamber, greatest causing an increase in the compression input of the low pressure stage compression mechanism, and accordingly, it has been desired to materialize a two stage compressor incorporating a more suitable compression timing arrangement.

It is noted that an arrangement in which the compression timings of the low pressure stage compression mechanism and the high pressure stage compression mechanism are shifted from each other by an angle of 180 deg. as described as a prior art example in the Japanese Laid-Open Patent No. 1-247785, is also proposed by Japanese Laid-Open No. 60-128990.

However, the arrangement in which the compression timings of both compression mechanisms are shifted from each other by an angle of 180 deg. (refer to FIG. 14), exhibits many excessive discharge volume ranges, as is clear from FIG. 15 which is an explanatory view showing the volume of the discharge gas from and the discharge timing of the low pressure stage compression mechanism, the suction volume and the suction timing of the high pressure stage compression mechanism, and excessive and insufficient conditions of the discharge gas volume from the low pressure stage compression mechanism, and accordingly, it is clear from the above-mentioned explanation that the compression efficiency is low.

Further, as proposed by Japanese Laid-Open Patent No. 1-277695, in such an arrangement that the compression timings of both compression mechanisms are set to be simultaneous with each other, an insufficient discharge volume range always exists, and as a result, the compression ratio of the high pressure stage compression mechanism becomes large, as clearly from FIG. 16 which is an explanatory view showing the volume of discharge gas from and the discharge timing of the low pressure stage compression mechanism, the suction volume and the suction timing of the high pressure stage compression mechanism, and excessive and insufficient conditions of the discharge gas volume from the low pressure stage compression mechanism, thereby it is possible to understand that the compression efficiency is low.

As mentioned above, although it is clear that the setting of an excessive discharge volume range affects the compression efficiency, the smaller the range, the larger the insufficient discharge range becomes, resulting in that the pressure pulsation produced in the intermediate passage becomes larger.

This pressure pulsation causes the compression ratio of the high pressure stage compression mechanism to excessively vary so as to induce a jumping action of a vane. As a result, high impinging sound produced between the tip end of the vane and a roller and vibration accompanied thereby become larger, and accordingly, gas leakage between the compression chamber and the suction chamber becomes larger so as to cause a problem of remarkably lowering the compression efficiency and the durability.

As mentioned above, although various proposals have been made in order to aim at enhancing the efficiency of two stage compressors, and it has been desired that a two stage compressor having a further enhanced efficiency is materialized.

DISCLOSURE OF THE INVENTION

The present invention is devised in view of the above-mentioned problems, and accordingly, one object of the present invention is to reduce excessive compression and insufficient compression so as to aim at enhancing the compression efficiency by optimizing the compression timings of the low pressure stage compression mechanism and the high pressure stage compression mechanism.

Specifically, a motor, and a low pressure stage compression element and a high pressure stage compression element which are driven by the motor, are disposed in a closed container so as to constitute a two stage compression mechanism in which the discharge side of the low pressure stage compression element is coupled in series with the suction side of the high pressure stage compression element through the intermediary of a communication passage, a passage for discharging coolant compressed in the high pressure stage compression element into the closed container is formed, and the cylinder volume of the high pressure stage compression element is set to 45 to 65% of that of the low pressure stage compression element while both compression elements being arranged so as to delay the compression efficiency of the high pressure stage compression element from the compression timing of the low pressure stage compression element by an angle of 60 to 80 deg.

BRIEF DESCRIPTION OF THE DRAWINGS

FIG. 20(*b*) is a sectional view illustrating an arrangement of parts of a low pressure stage compression element in the compressor;

BEST MODE OF THE INVENTION

Explanation will be made hereinbelow of a rolling piston type rotary two stage coolant compressor in a first embodiment of the present invention with reference to FIGS. 17 to 25.

Figure 17:
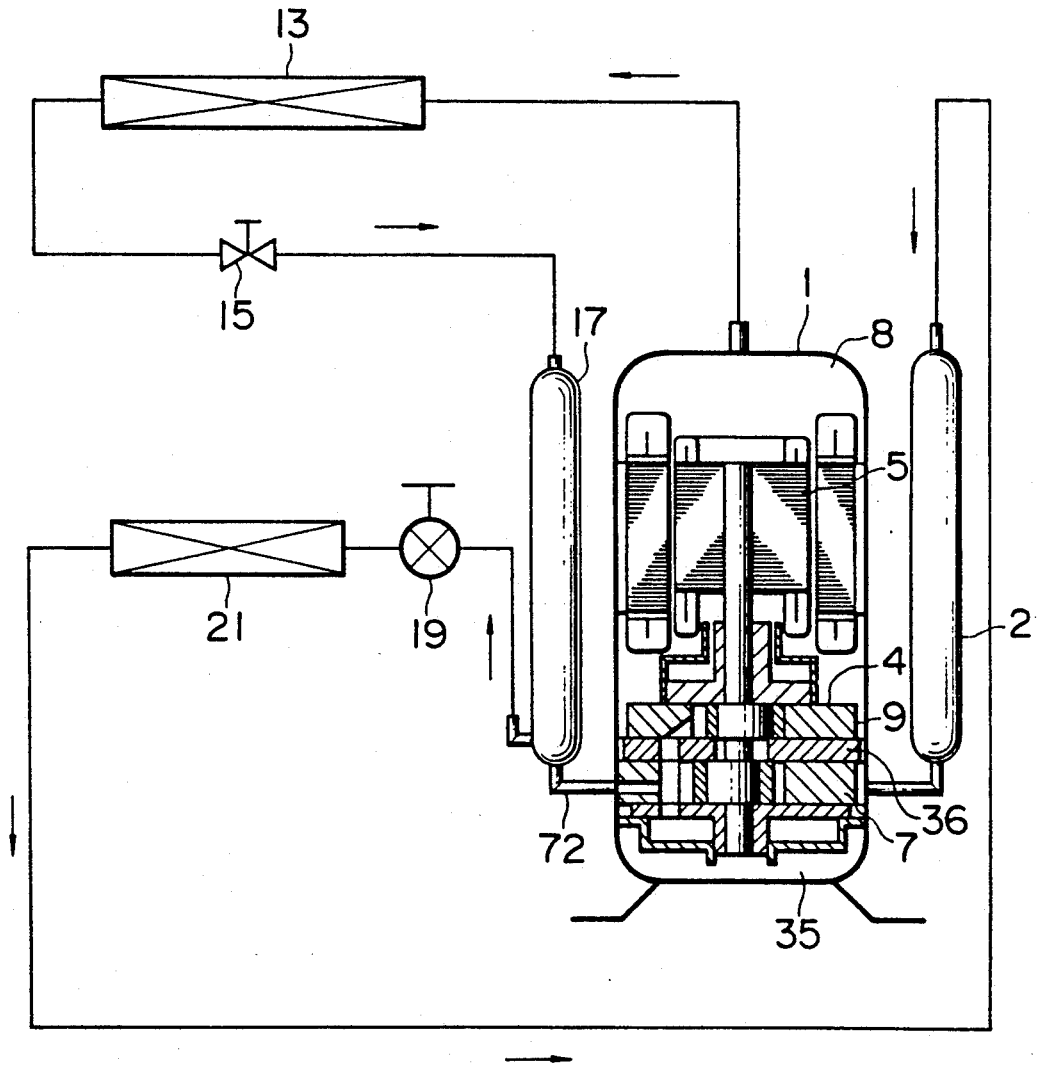
FIG. 17 is a view illustrating a pipe line system for a two-stage compression and two-stage expansion refrigerating cycle in which a two stage coolant compressor in one embodiment of the present invention is used.
Figure 18:
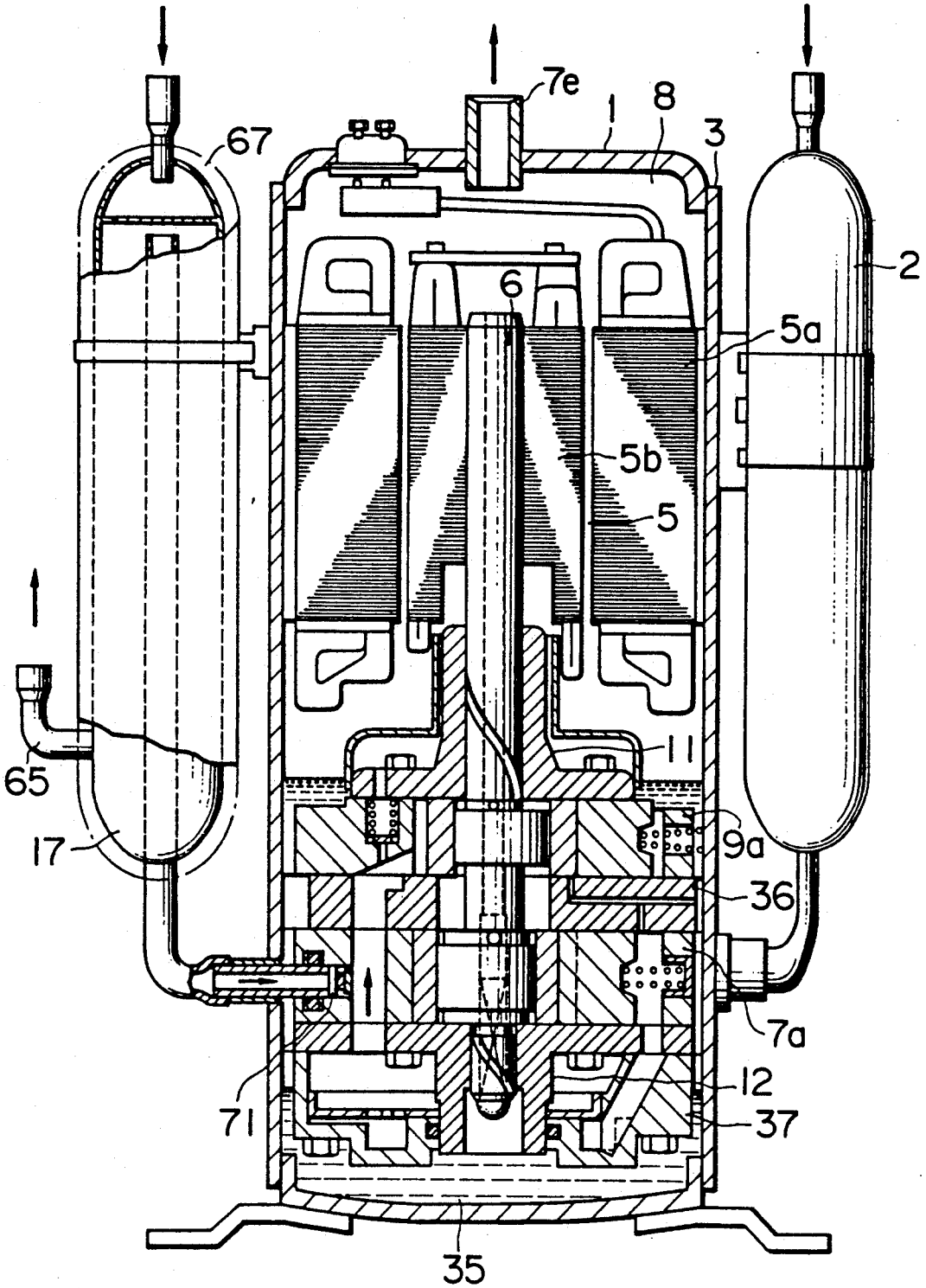
FIG. 18 is a transverse sectional view illustrating the compressor.
Figure 19:
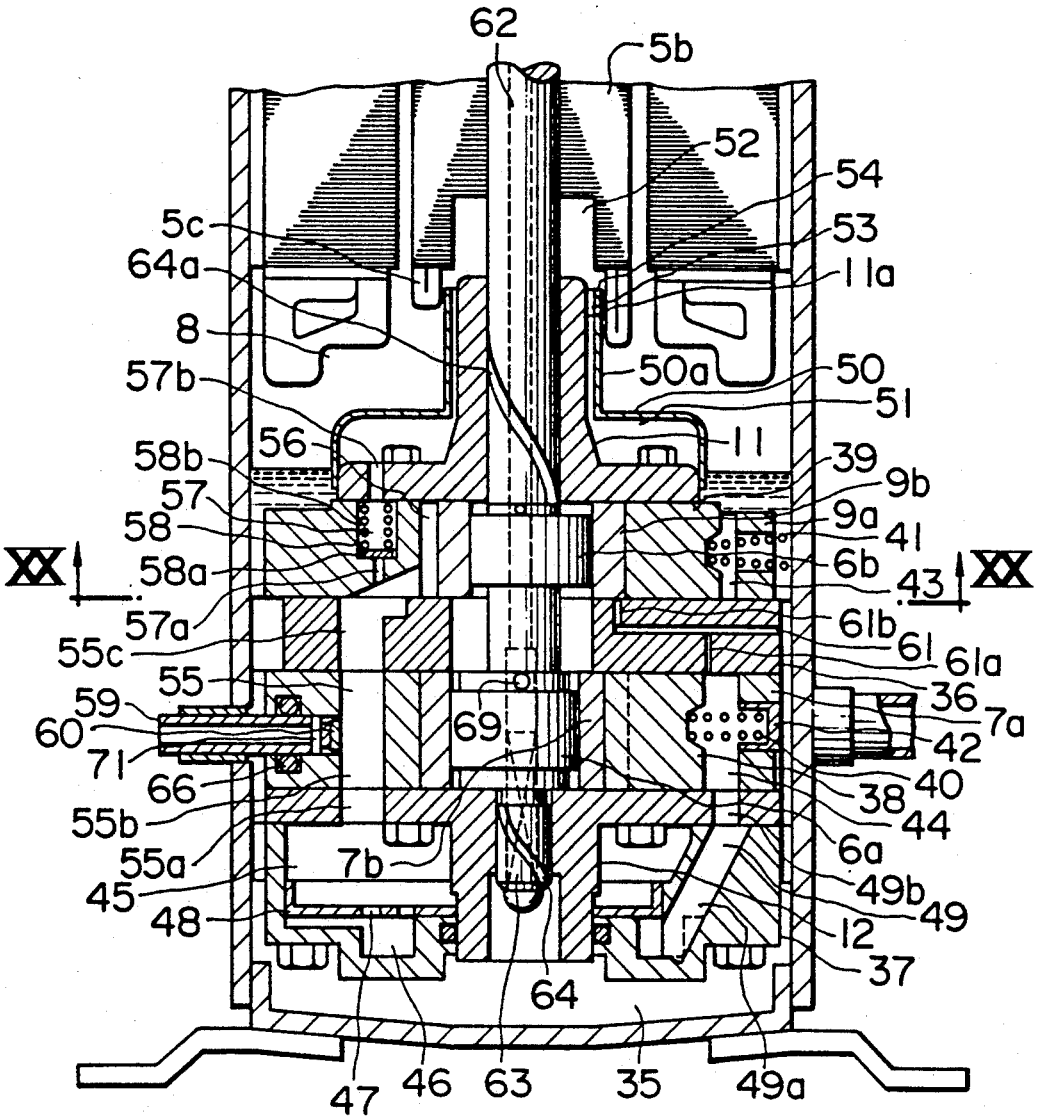
FIG. 19 is a sectional view illustrating an essential part of compression portion of the compressor.

FIG. 17 shows a pipe line system of a two stage compression and two stage expansion refrigerating cycle in which a rolling piston type rotary two stage compressor 1 incorporating an accumulator 2, a condenser 13, a first expansion valve 15, a gas-liquid separator 17, a second expansion valve 19 and an evaporator 21 are connected in that order; FIG. 18 is a sectional view illustrating the rolling piston type rotary two stage compressor 1, and FIG. 19 shows the details of an essential part of a two stage compression mechanism.

Within a closed container 3, a motor 5 is disposed in a motor chamber 8 in the upper space of the container 3, a two stage compression mechanism 4 is disposed below the motor 5 around and below which an oil sump 35 is defined.

The stator 5*a* of the motor 5 is shrinkage-fitted in the inner wall of the closed container 3.

The two stage compression mechanism 4 is composed of a high pressure stage compression element 9 in the upper part, a low pressure stage compression element 7 in the lower part, and a planar intermediate plate 36 interposed between both compression elements 7, 9, and is secured to the inner wall of the closed container 3 at several positions (which are not shown) on the outer peripheral parts of a discharge cover A37 of the low pressure stage compression element 7 and the intermediate plate 36.

The cylinder volume of the high pressure stage compression element 9 is set to 45 to 65% of that of the low pressure stage compression element 7.

A drive shaft 6 which is supported by an upper bearing member 11 attached to the upper surface of a second cylinder block 9*a* of the high pressure stage compression element 9 and a lower bearing member 12 attached to the lower surface of a first cylinder block 7*a* of the low pressure stage compression element 7, is coupled and secured to the rotor 5*b* of the motor 5.

The eccentric directions of the first crank-shaft 6*a* and a second crankshaft 6*b* of the drive shaft 6 are shifted by an angle of 180 deg. from each other.

Figure 20A:
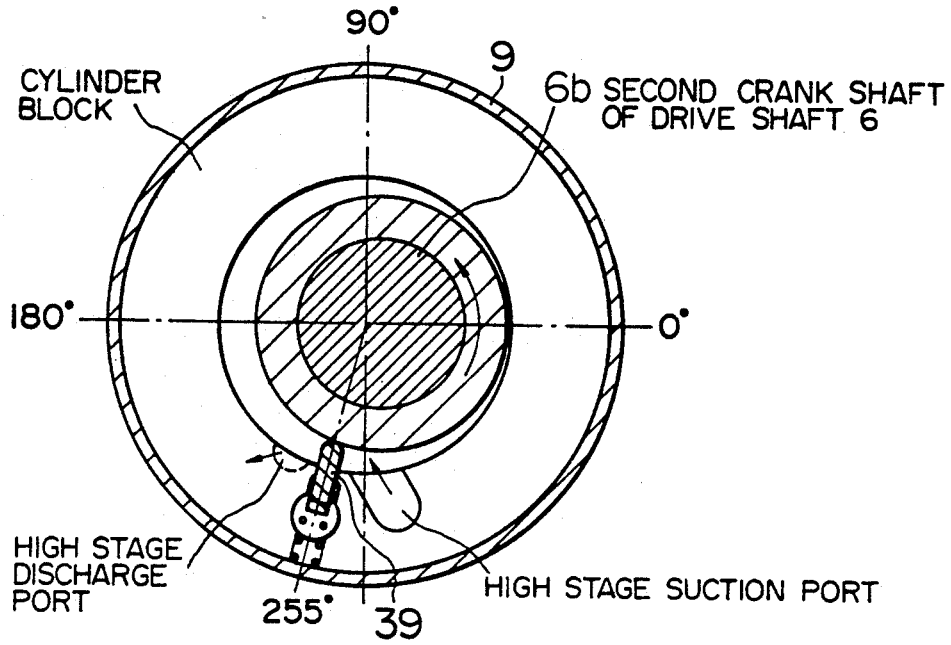
FIG. 20(*a*) is a sectional view illustrating an arrangement of parts of a high pressure stage compression element in the compressor.
Figure 20B:
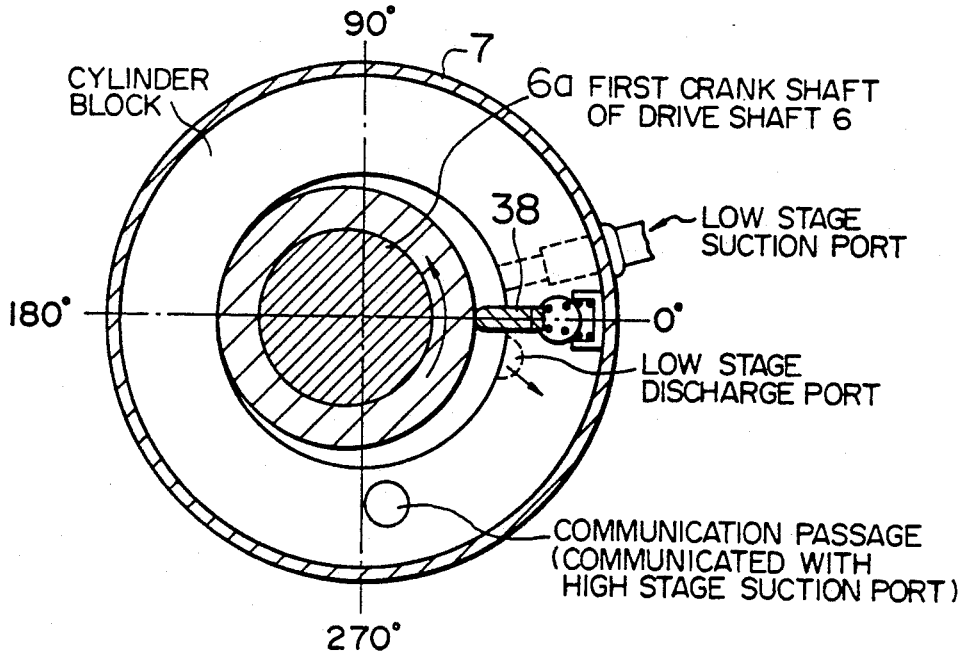

As shown in FIG. 20, the high pressure stage compression element is arranged in such a way that it initiates its suction and compression operations with a phase lag of 75 deg. with respect to the suction and compression timings of the low pressure stage compression element 7 so as to restrain an excessive pressure rise in a low pressure stage discharge chamber 45 in order to reduce the compression power consumed in the low pressure stage compression element 7.

Vanes 38, 39 abut against the outer peripheral surfaces of first and second pistons 7*b*, 9*b* fitted respectively on the first and second crankshafts 6*a*, 6*b* of the drive shaft 6 so as to divide the cylinders of the low and high pressure stage compression elements 7, 9 into a suction chamber and a compression chamber, and the coil springs 40, 41 urge the vanes 38, 39 at the rear surfaces of the latter.

The rear end part of the coil spring 41 in the high pressure stage compression element 9 is supported at the inner wall of the closed container 3 while the rear end part of the coil spring 42 in the low pressure stage compression element 7 is supported by a cap 42 sealingly attached to the first cylinder block 7*a*.

A rear chamber B43 for the vane 39 in the high pressure stage compression element 9 is opened to the oil sump 35, but a rear chamber A44 for the vane 38 in the low pressure stage compression element 7 is sealed at its one end by the cap 42 so that the communication to the oil sump 35 is blocked.

The discharge cover A37 of the low pressure stage compression element 7 is attached to the lower bearing member 12 so as to define a low stage compression chamber 45, and the bottom part thereof defines therein a discharge chamber oil sump 46.

The discharge chamber oil sump 46 is secured to the discharge cover A37, and is partitioned from the upper space of the low stage discharge chamber 45 by means of a partition plate 48 having a plurality of small holes 47, and the bottom part thereof is communicated with the rear chamber 44 for the vane 38 through an oil return passage 49 composed of oil return holes 49*a*, 49*b* which are formed in the discharge cover A37 and the lower bearing member 12.

A discharge cover B50 formed of a vibration suppressing steel plate is disposed surrounding the outer periphery of the upper bearing member 11 so as to define a high stage discharge chamber 51.

A sound suppressing chamber 52 which is a recess formed in one end part of the rotor 5*b* of the motor 5 is communicated with the high stage discharge chamber 51 through the intermediary of an annular passage 53 between a projection 11*a* of the upper bearing member 11 and a projection 50*a* of the cover B50 surrounding the outer periphery of the projection 11*a*, and is also communicated with the internal space of the closed chamber 3 through an annular passage 54 between the inner surface of an end ring 5*c* of the rotor 5*b* and the projection 50*a* of the discharge cover B50.

The low stage discharge chamber 45 and an suction chamber 56 in the high pressure stage compression element 9 are communicated with each other through the intermediary of a communication passage 55 composed for a gas passage A55*a* formed in the lower bearing member 12, a gas passage B55*b* formed in the first cylinder block 7*a* and a gas passage C55*c* formed in the intermediate plate 36.

A bypass passage 57 branching from the communication passage 55 is composed of a bypass passage A57*a* and a bypass passage B57*b* which are formed in the second cylinder block 9*a* of the high pressure stage compression element 9 and the upper bearing member 11, respectively, and is opened at its downstream side to the high stage discharge chamber 51.

Figure 21:
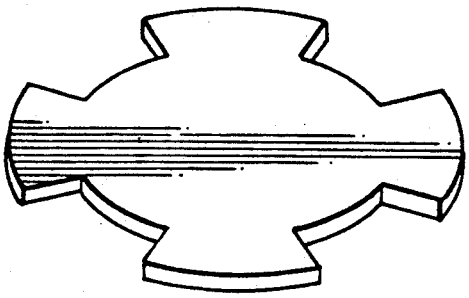
FIG. 21 is a perspective view illustrating a bypass valve used in the compressor.
Figure 22:
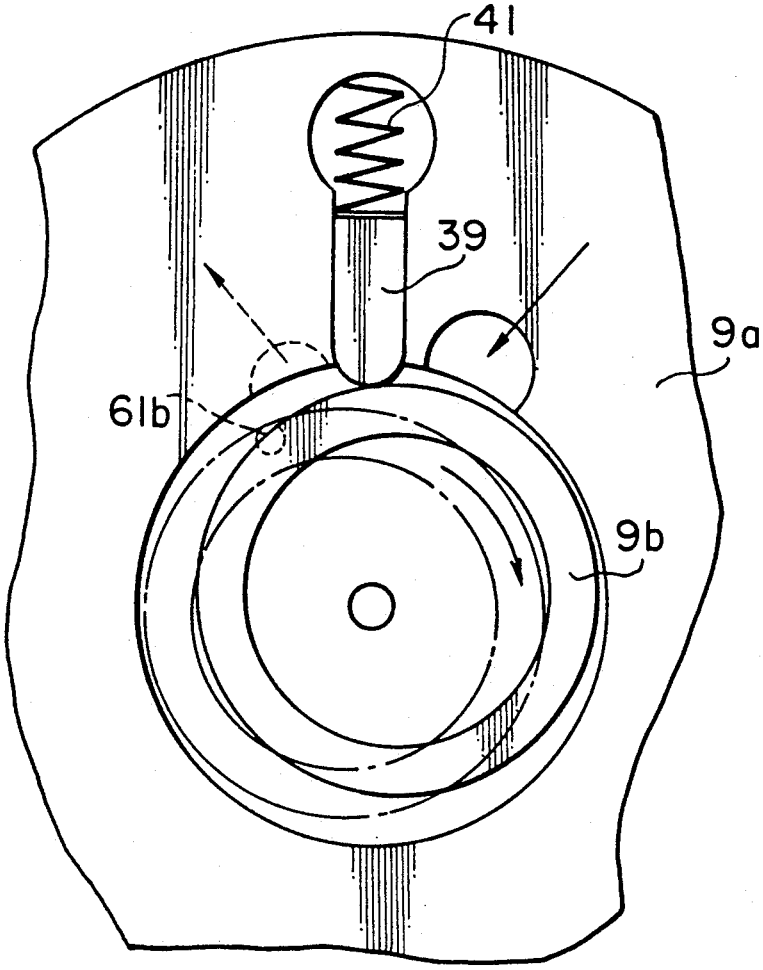
FIG. 22 is a partial plan view along the line A—A in FIG. 19.

The bypass passage A57*a* is disposed therein with a bypass valve device 58 which is composed of a valve element 58 (the external shape thereof is shown in FIG. 21) having at its outer periphery a notch and made of a steel sheet, and a coil spring 58*b*, and which allows only a fluid stream from the communication passage 55 into the high stage discharge chamber 51.

The coil spring 58*b* has a shape memory alloy characteristic in which its spring constant increases as the temperature thereof rises, so as to increase its urging force for the valve element.

The gas passage B55*b* which is a part of the communication passage 55 is communicated with the downstream side of the gas-liquid separator 17 through the intermediary of a communication passage 59 so as to define a coolant injection passage 72.

The communication passage 59 is inserted in the first cylinder block 7*a*, having its connection part which is sealed at its outer periphery by an O-ring 66, and a valve element 60 having a shape similar to that shown in FIG. 21 is disposed between the end part thereof and the gas passage B55*b* so as to constitute a check valve device 71.

The check valve device 71 allows the fluid to flow only from the gas-liquid separator 17 into the gas passage B55*b*.

The intermediate plate 36 is formed therein with an oil injection passage 61 having a constriction intermediate thereof, and having its upstream side communicated with the oil sump 35 and its downstream side intermittently communicated with the rear chamber A44 for the vane 38 and the compression chamber in the high pressure stage compression element 9.

A downstream side passage A61*a* of the oil injection passage 61 and the rear chamber A44 are opened at the slide surface of the vane 44 so that they are communicated with each other during a period in which the vane 38 is advanced toward the piston 7*b* over more than about one half of its stroke, but are blocked off against each other during the other period.

A downstream side passage B61*b* of the oil injection passage 61 and the compression chamber in the high pressure stage compression element 9 are opened at positions so that the communication therebetween is initiated when the vane 39 is advanced toward the piston 7*b* by about one-third of its stroke, and the blockage therebetween is initiated by the slide end surface of the piston 9*b* when the vane 39 is returned by about one-third of its stroke.

The drive shaft 6 is formed therein with a shaft hole 62 piercing through therethrough along the center axis thereof, and a pump device 63 is attached to the lower part thereof.

Spiral oil grooves 64, 64*a* are formed on the outer peripheral surface of the drive shaft supported by the upper and lower bearing members 11, 12, the upstream side of the spiral oil groove 64 being communicated with the downstream side of the pump device 63 through the intermediary of a radial oil hole branching from the shaft hole 62, and the downstream side of the spiral oil groove 64 being not communicated with the sound suppression chamber 52.

The downstream side of the accumulator 2 is communicated with a suction chamber (which is not shown) in the low pressure stage compression element 7, and a discharge pipe 7*e* is provided in the upper part of the closed container 3.

The gas-liquid separator 17 has its bottom part which is connected thereto with a liquid pipe 65 communicated with the second expansion valve 19, and the outer surface of the barrel of the gas-liquid separator 17 is coated thereover with a polyethylene film, and heated so that it is subjected to a heat insulating process with a polyethylene foaming agent foamed up to about 5 mm.

Figure 23:
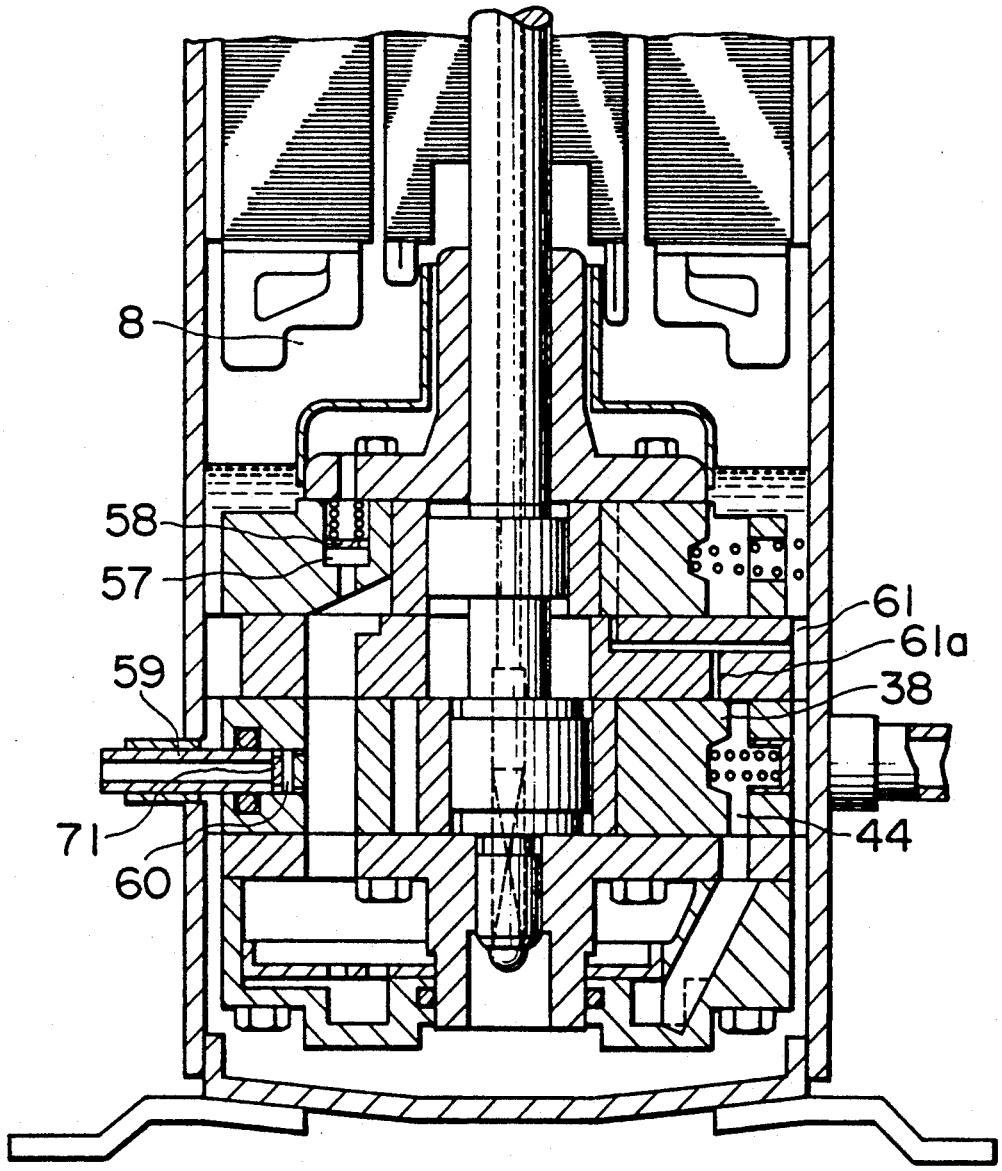
FIG. 23 is a sectional view of an essential part of the compression portion of the compressor, in which a bypass valve device and a check valve are shown in an operating condition.

FIG. 23 shows an opening condition of a bypass passage 57 just after cold start of the compressor, a condition in which one end part of the communication passage 59 is blocked by the valve element 60, and a condition in which the vane 38 blocks the communication between the downstream side passage 61*a* of the oil injection passage 61 and the rear chamber A44.

Figure 24:
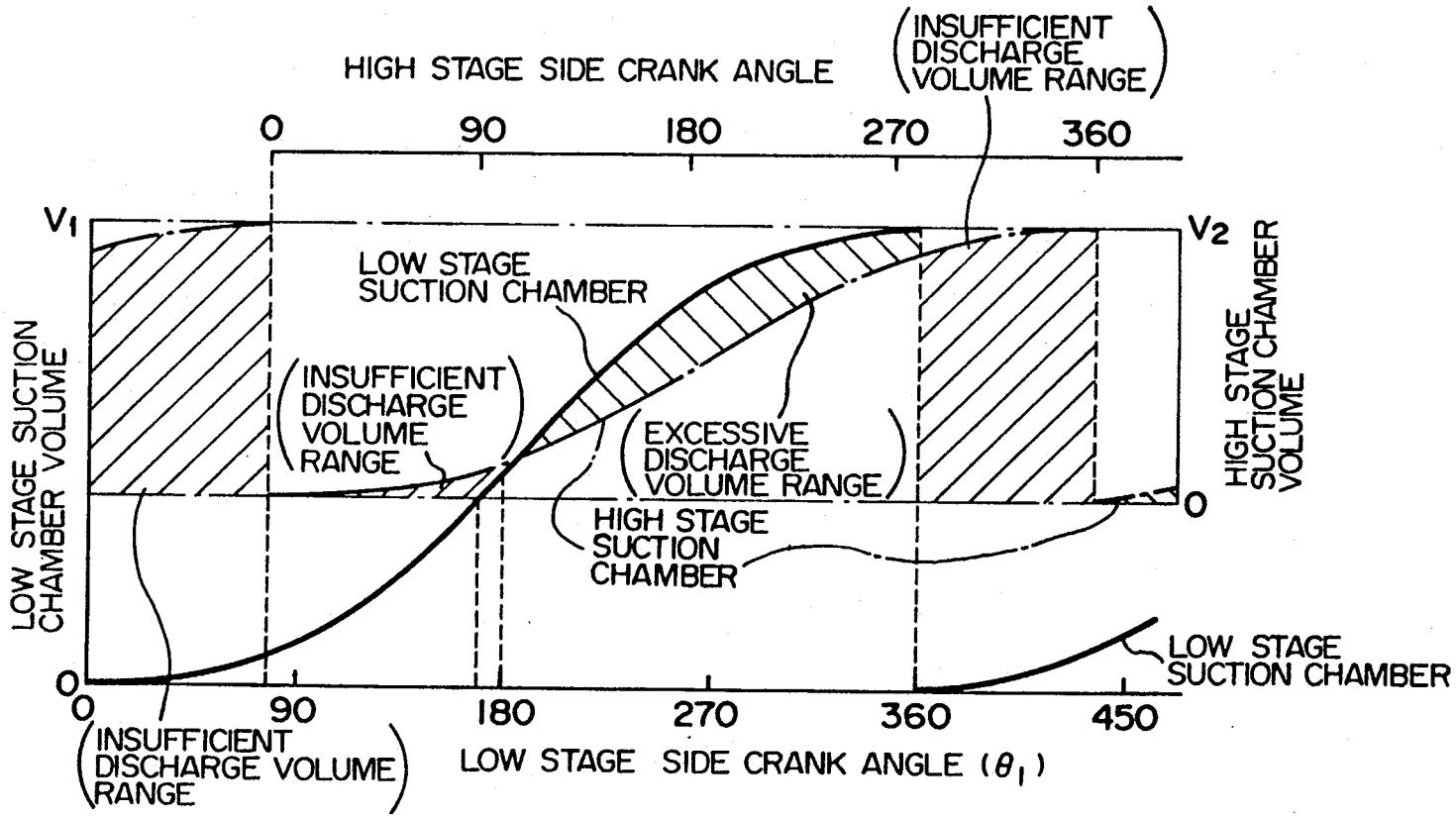
FIG. 24 is an explanatory view showing the compression initiating timings of the low pressure stage compression element and the high pressure stage compression element of the compressor, and excessive and insufficient conditions of the gas volume in accordance with a cylinder volume ratio.

FIG. 24 is an explanatory view showing the volume and the discharge timing of discharge gas from the low pressure stage compression element 7, and the suction volume and the suction timing of the high pressure stage compression element 9 in accordance with the compression timing and the cylinder volume of the above-mentioned compressor, and excessive and insufficient conditions of volume of discharge gas from the low pressure stage compression element 7.

Figure 25:
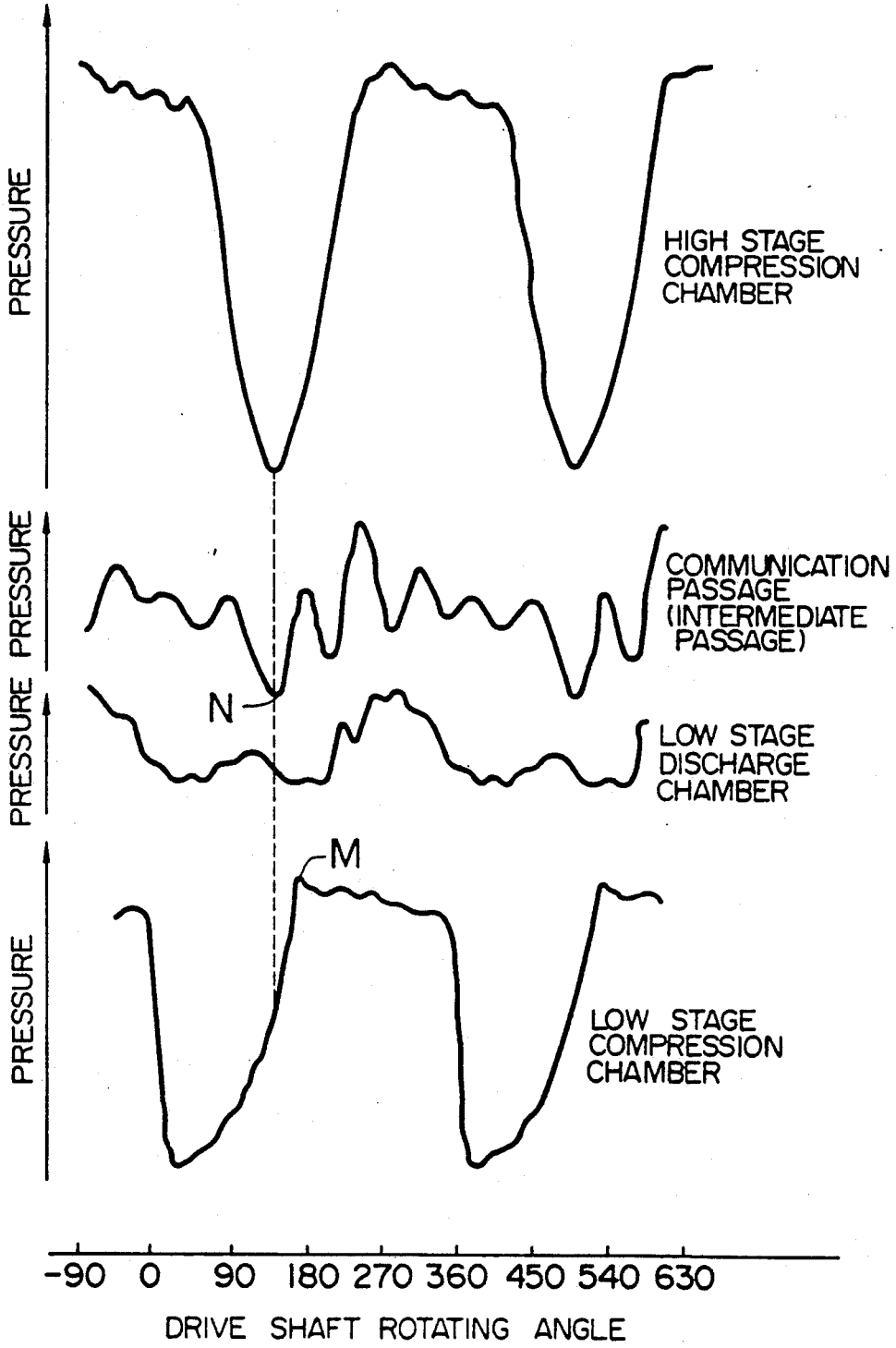
FIG. 25 is a characteristic view showing variation in the internal pressure of the compressor in a correlation between the rotational speed of the drive shaft (abscissa) and the pressure (ordinate)

FIG. 25 is a characteristic view showing variation in pressure in the inside (low stage compressor chamber, a low stage discharge chamber, the intermediate passage and the high stage compression chamber) of the above-mentioned compressor in a correlation between the crank shaft rotational angle (abscissa) and the pressure (ordinate).

Figure 26:
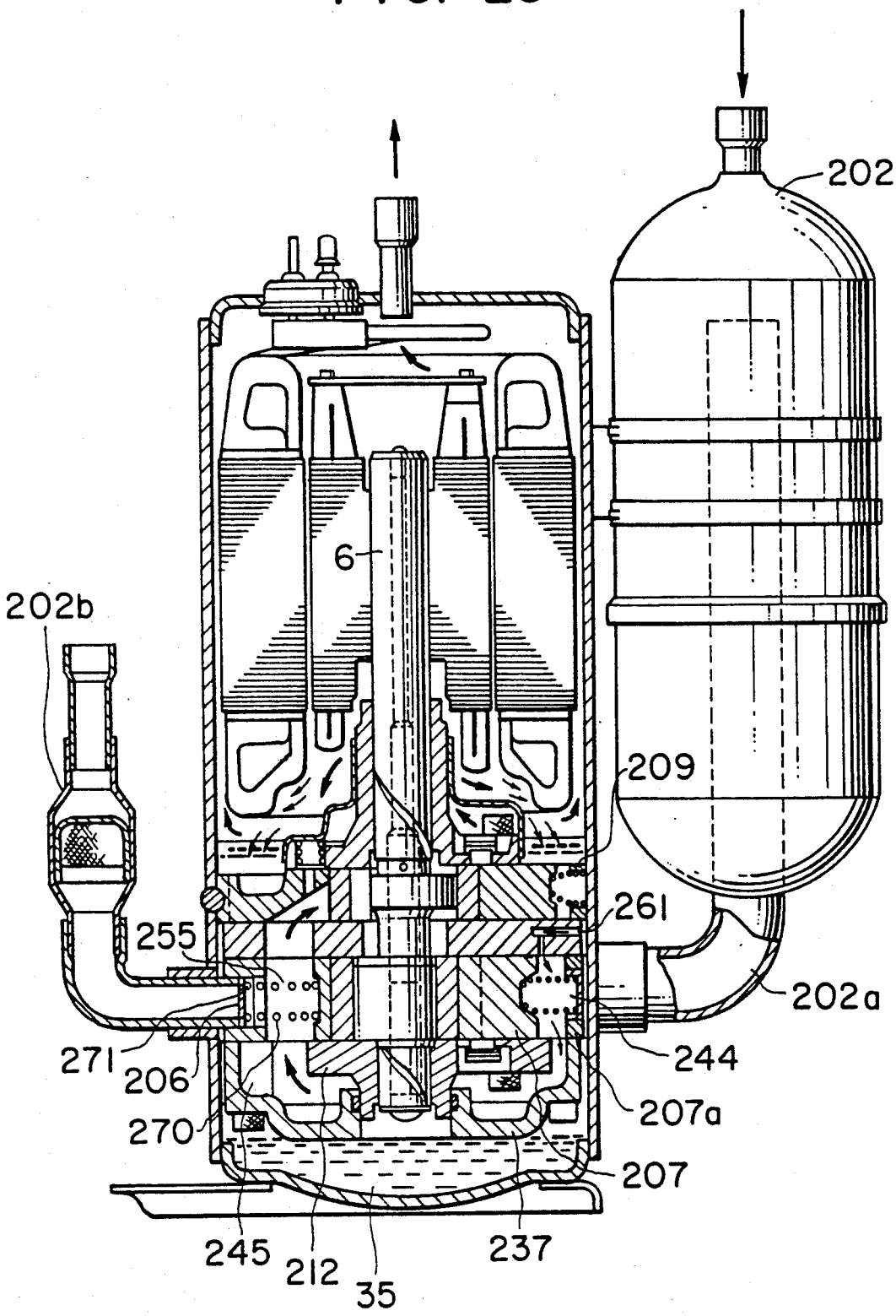
FIG. 26 is a sectional view illustrating the essential part of the compression portion of a two stage coolant compressor incorporating a check valve device in a second embodiment of the present invention.

Next, explanation will be made of a rolling piston type rotary two stage coolant compressor in a second embodiment of the present invention with reference to FIG. 26.

The downstream side of a first accumulator 202 provided thereto with a suction pipe 202*a* having a bore diameter which is about 1.5 times as large as that of the suction pipe of a conventional accumulator used for conventional compressors so as to restrain the excessive suction of the accumulator (which is a phenomenon such that the gas pressure in the suction pipe exhibits pulsation, following the suction operation of the compressor so that gas whose pressure is cyclically raised flows into the suction chamber and is then compressed in this condition, thereby the suction efficiency is raised) is connected to the suction side of the low pressure stage compression element 207, similar to the first embodiment.

A low stage discharge chamber 245 of the low pressure stage compressor element 207 is composed of a first cylinder block 207*a* and a discharge cover A237 which is attached to the first cylinder block 207*a* so as to surround the lower bearing member 211 supporting the drive shaft 6, and has an internal volume which is smaller than that of the arrangement of the first embodiment.

The upper part of a low stage discharge chamber 245 communicated with a rear chamber A244 is connected to suction side of the high pressure stage compression element 209 through the intermediary of a communication passage 255, and a second accumulator 202*b* connected to the intermediate part of the communication passage 255 is connected, at its downstream side, to the gas-liquid separator (not shown), as is similar to the first embodiment, having a downstream side connection end to which a valve element 206 similar to that in the first embodiment is fitted.

The valve element 206 is urged by a coil spring 207 for blocking the opening end of the connection from the gas-liquid separator 17, the coil spring 270 incorporating a shape memory characteristic such that its spring constant decreases as the temperature thereof rises so as to decrease the urging force for the valve element 206. Further, the end face of the communication pipe 59, the valve element 206 and the check valve 271 constitute a check valve device 271 in combination.

The arrangement other than that mentioned above is similar to that in the first embodiment, and accordingly, explanation thereof will be abbreviated.

Explanation will be made of the operation of the two stage compressor constituted as mentioned above, and the refrigerating cycle thereof.

Figure 1:
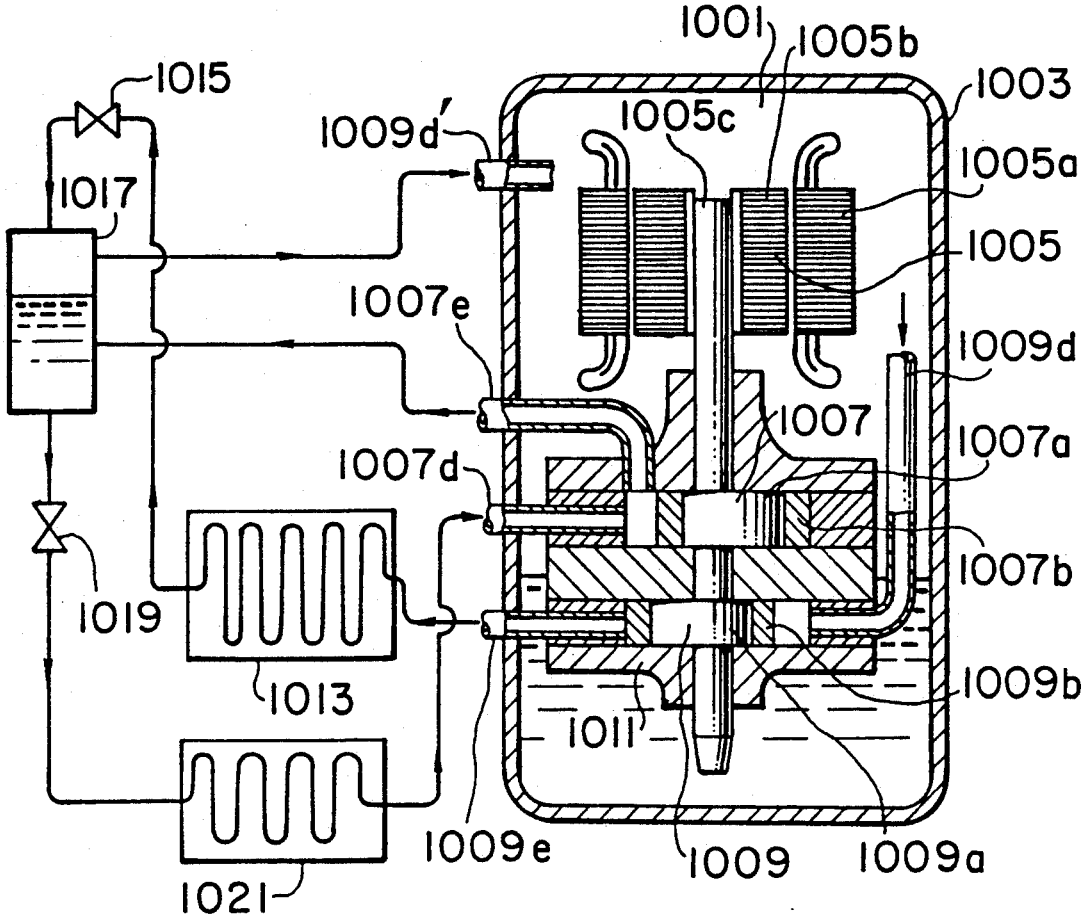
FIG. 1 PRIOR ART
FIG. 1 is a view illustrating a pipe line system of a two-stage compression and two-stage expansion refrigerating cycle in which a conventional two stage coolant compressor is used.
Figure 2:
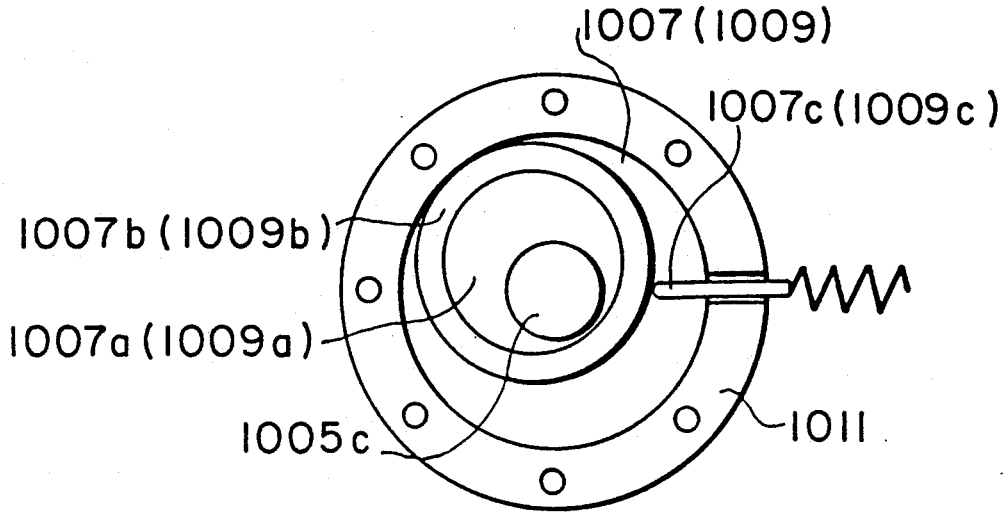
FIG. 2 PRIOR ART
FIG. 2 is a plan view illustrating a compression mechanism in the compressor.
Figure 3:
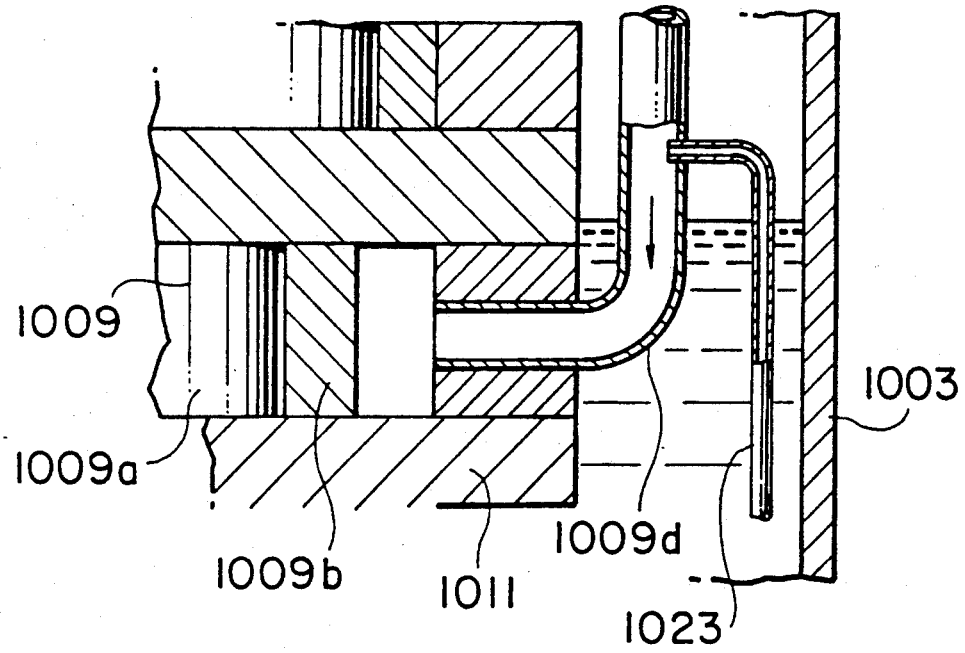
FIG. 3 PRIOR ART
FIG. 3 is a detailed sectional view illustrating a lubricating device in the compressor.
Figure 4:
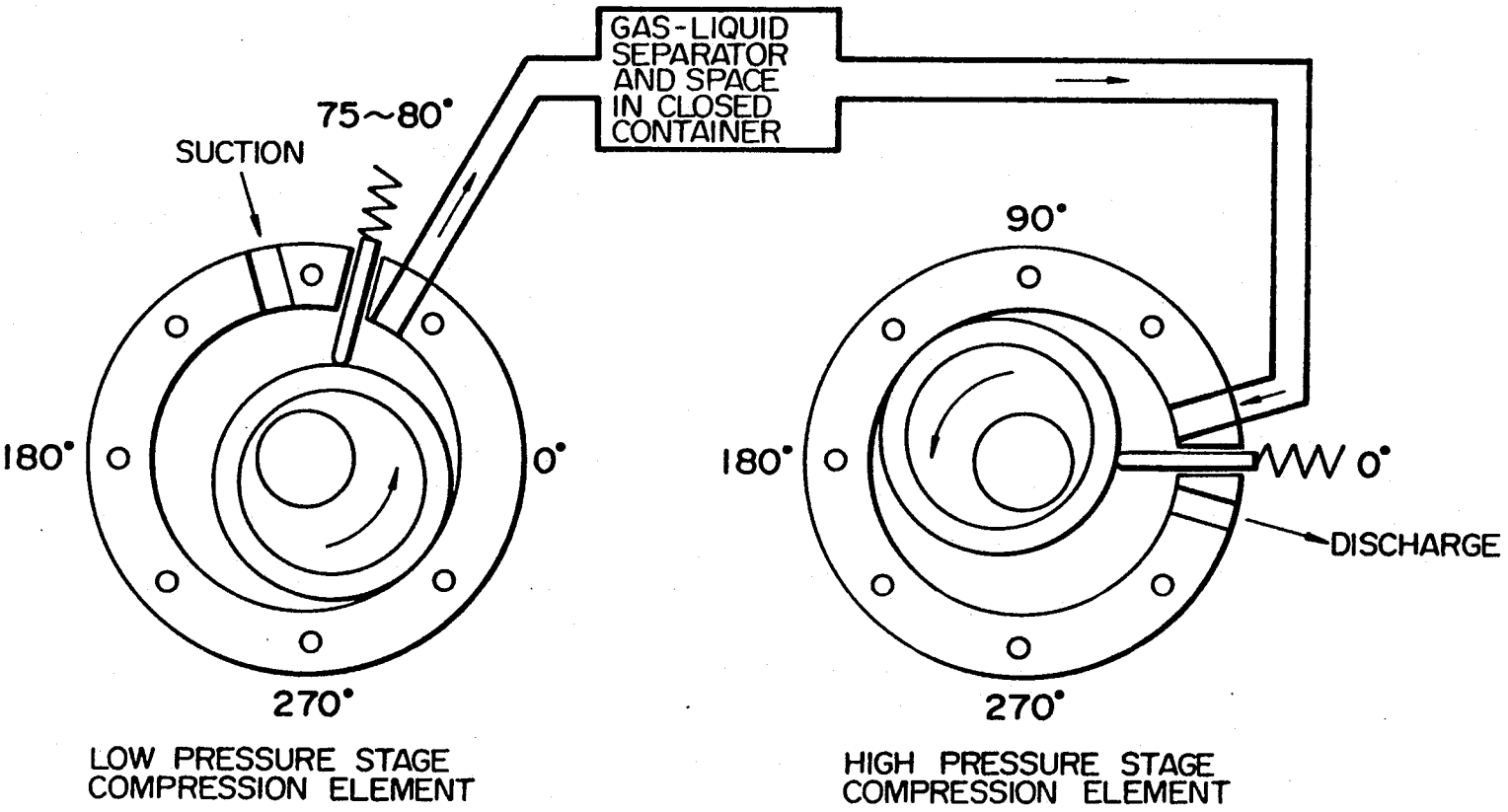
FIG. 4 PRIOR ART
FIG. 4 is an explanatory view showing the compression initiating timings of a low pressure stage compression element and a high pressure stage compression element in the compressor.
Figure 5:
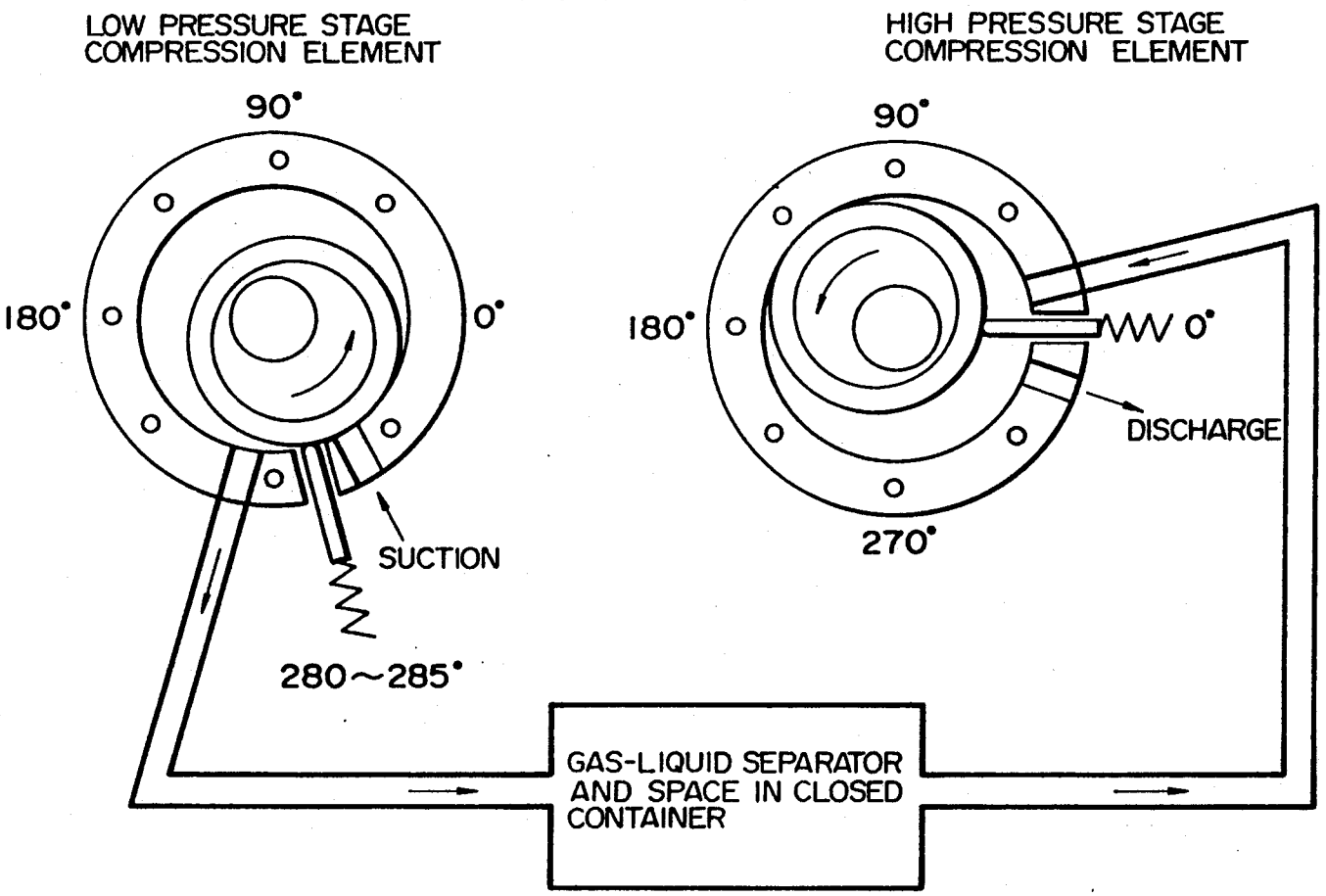
FIG. 5 PRIOR ART
FIG. 5 is an explanatory view showing other compression initiating timings of the low pressure stage compression element and the high pressure stage compression element in the compressor.
Figure 6:
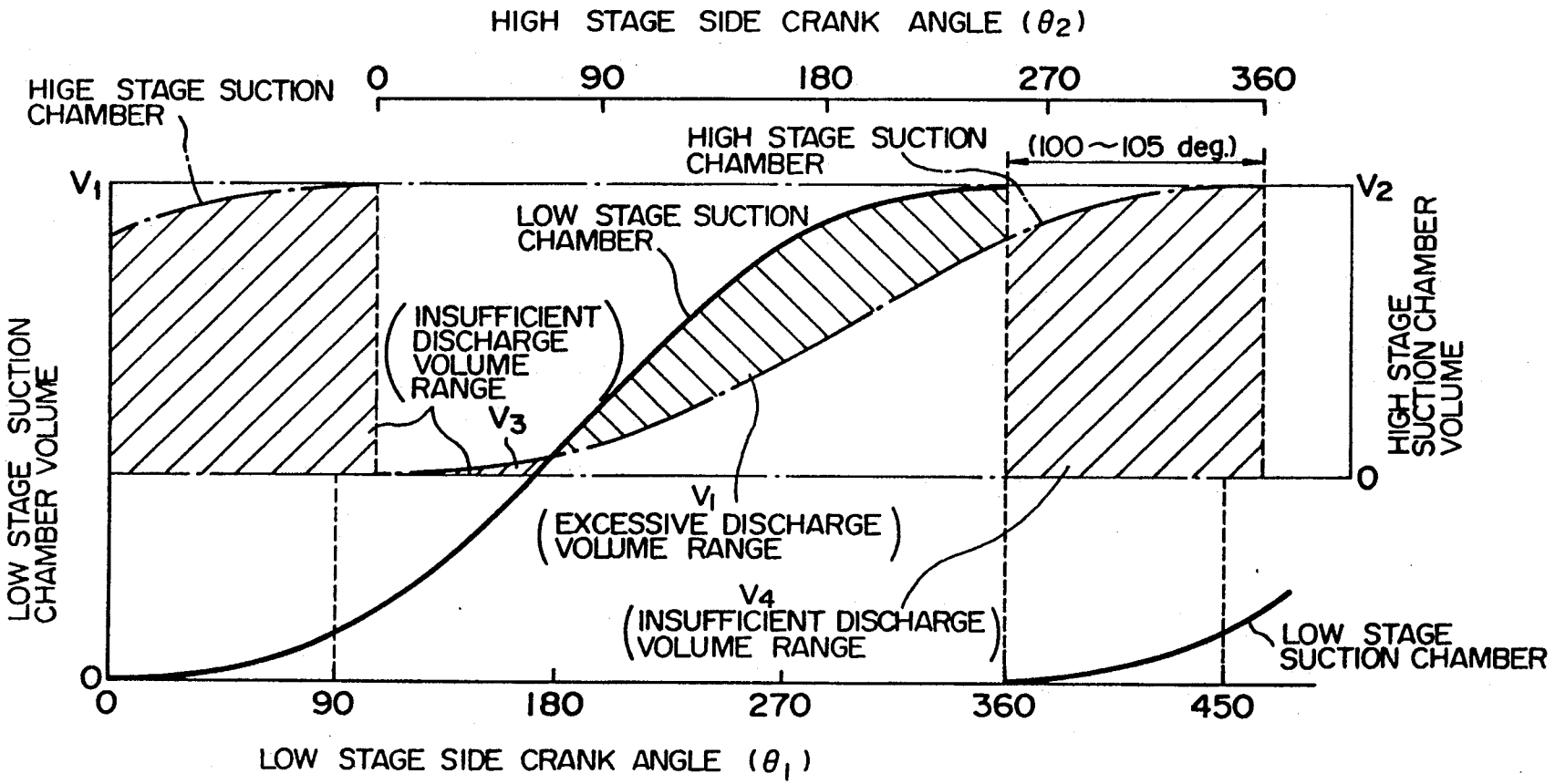
FIG. 6 PRIOR ART
FIG. 6 is an explanatory view showing excessive and insufficient conditions of gas volume at the compression timings shown in FIG. 4.
Figure 7:
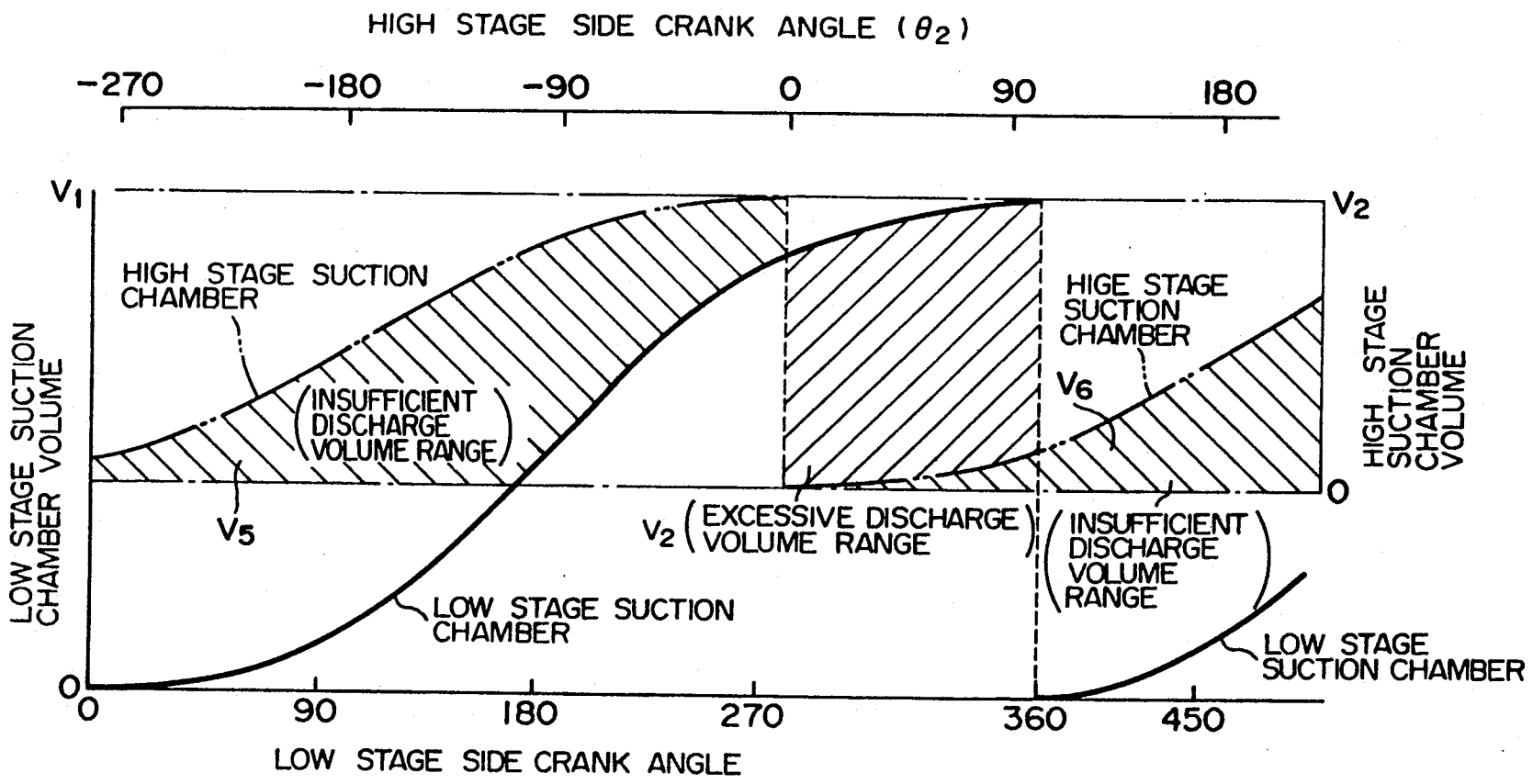
FIG. 7 PRIOR ART
FIG. 7 is an explanatory view showing excessive and insufficient conditions of gas volume at compression initiating timings shown in FIG. 5.
Figure 8:
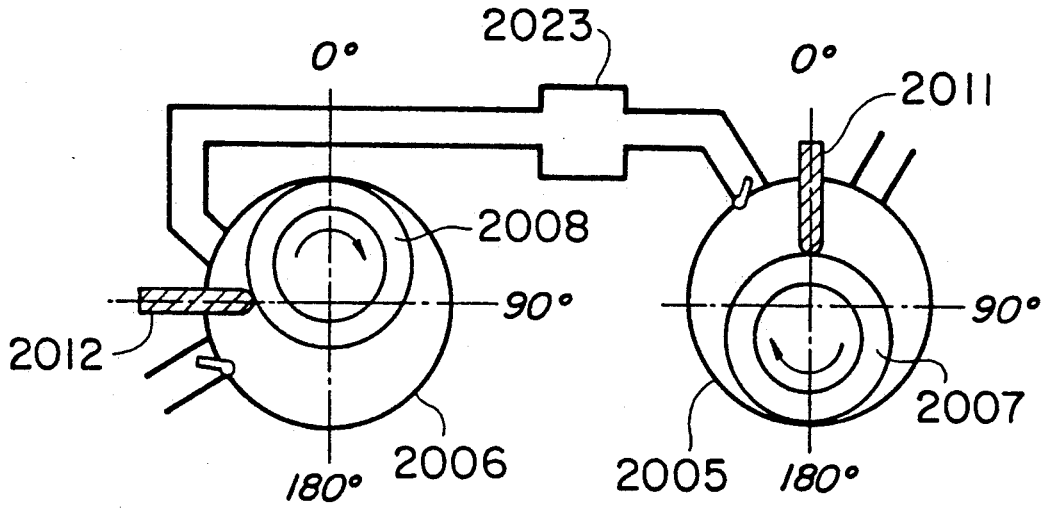
FIG. 8 PRIOR ART
FIG. 8 is an explanatory view showing compression timings of a low pressure stage compression element and a high pressure stage compression element in another conventional first two stage compressor.
Figure 9:
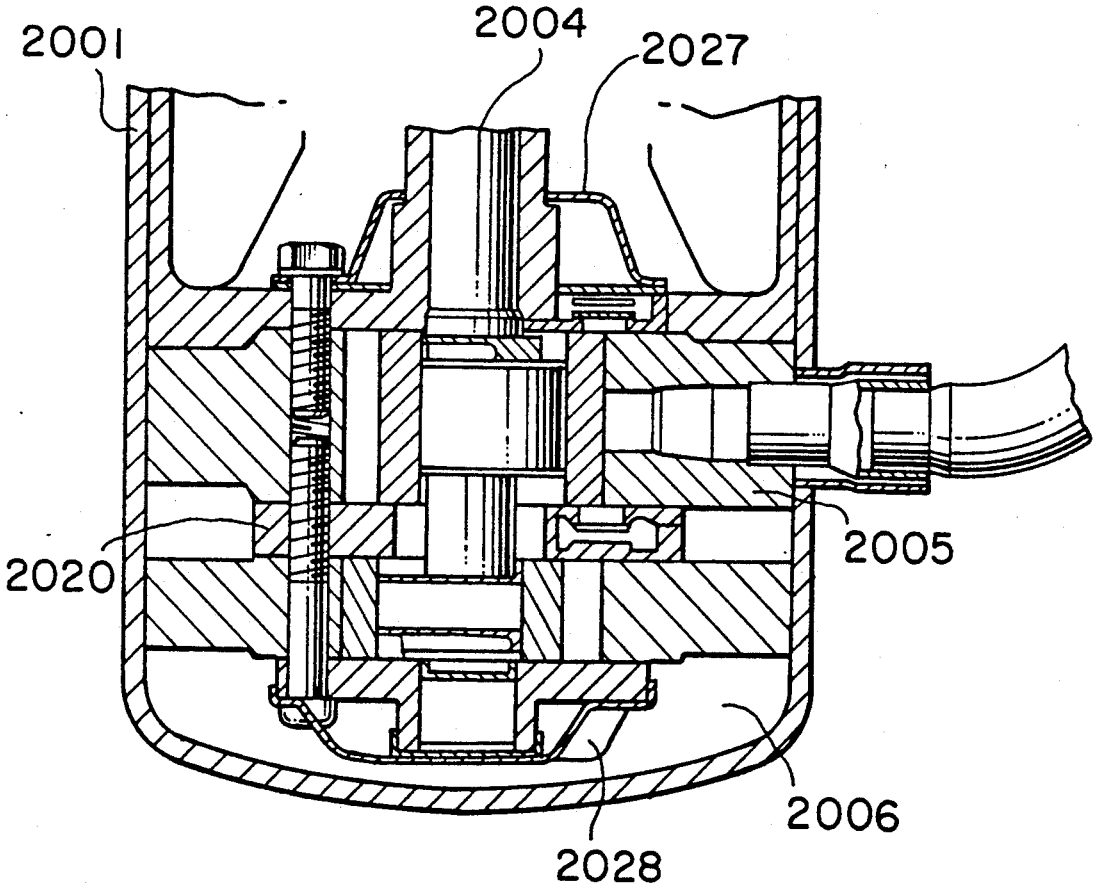
FIG. 9 PRIOR ART
FIG. 9 is a partial sectional view illustrating the compressor.
Figure 10:
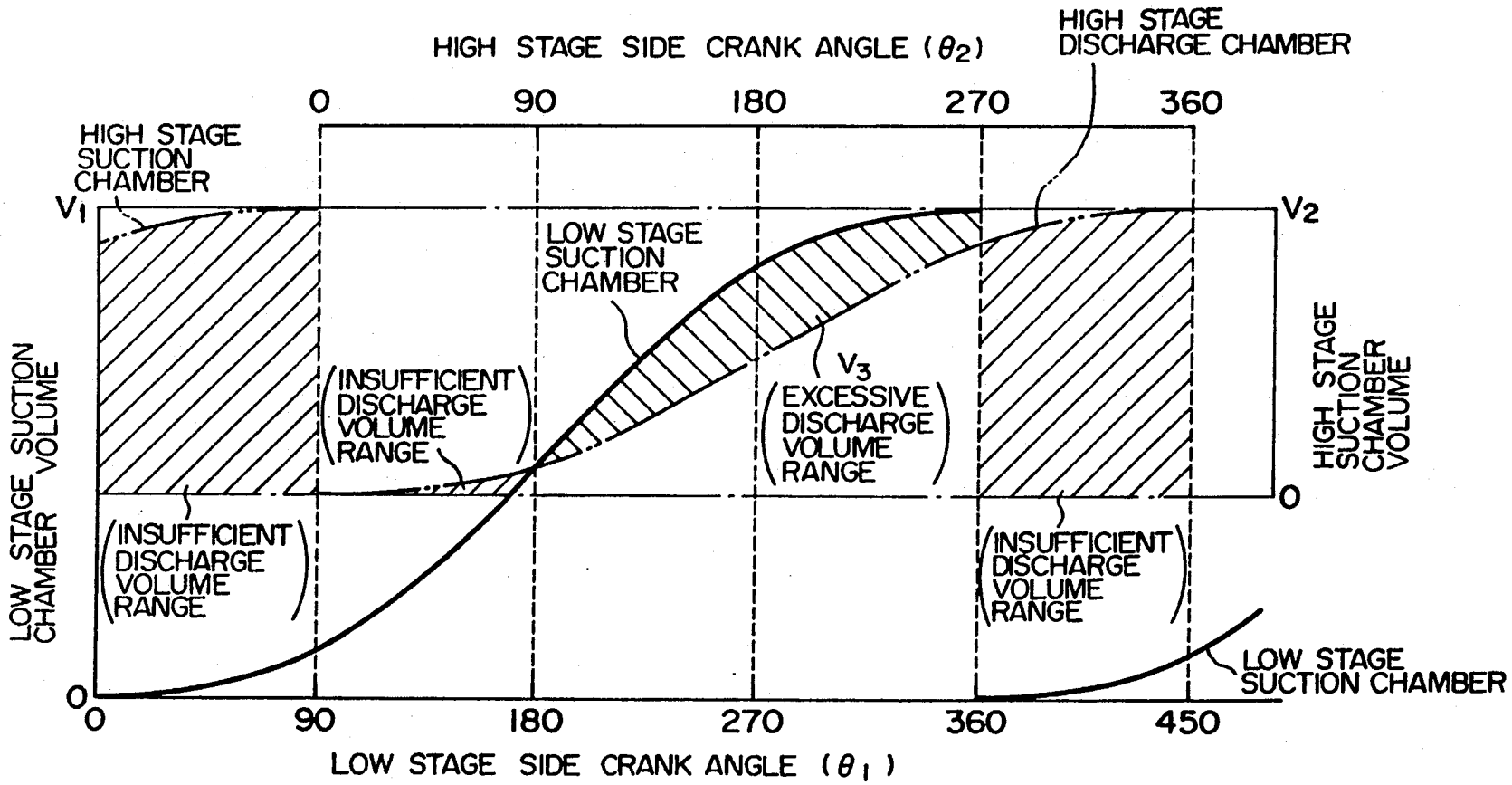
FIG. 10 PRIOR ART
FIG. 10 is an explanatory view showing excessive and insufficient conditions of gas volume at the compression initiating timings of the compressor.
Figure 11:
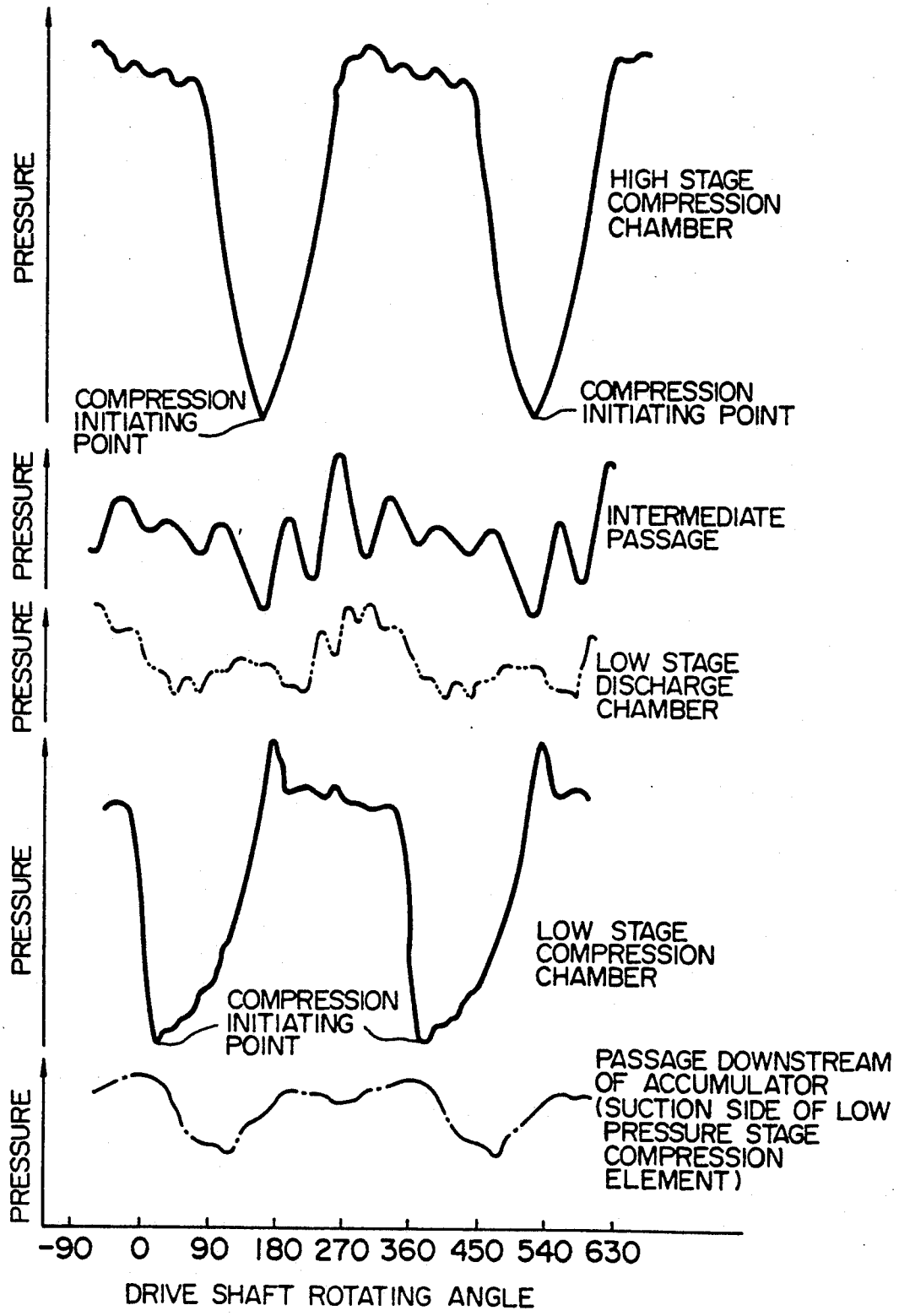
FIG. 11 PRIOR ART
FIG. 11 is a characteristic view in which pressure variations in various parts in the compressor are successively arranged along the stream of coolant gas in relation between the drive shaft rotating angle (abscissa) and the pressure (ordinate)
Figure 12:
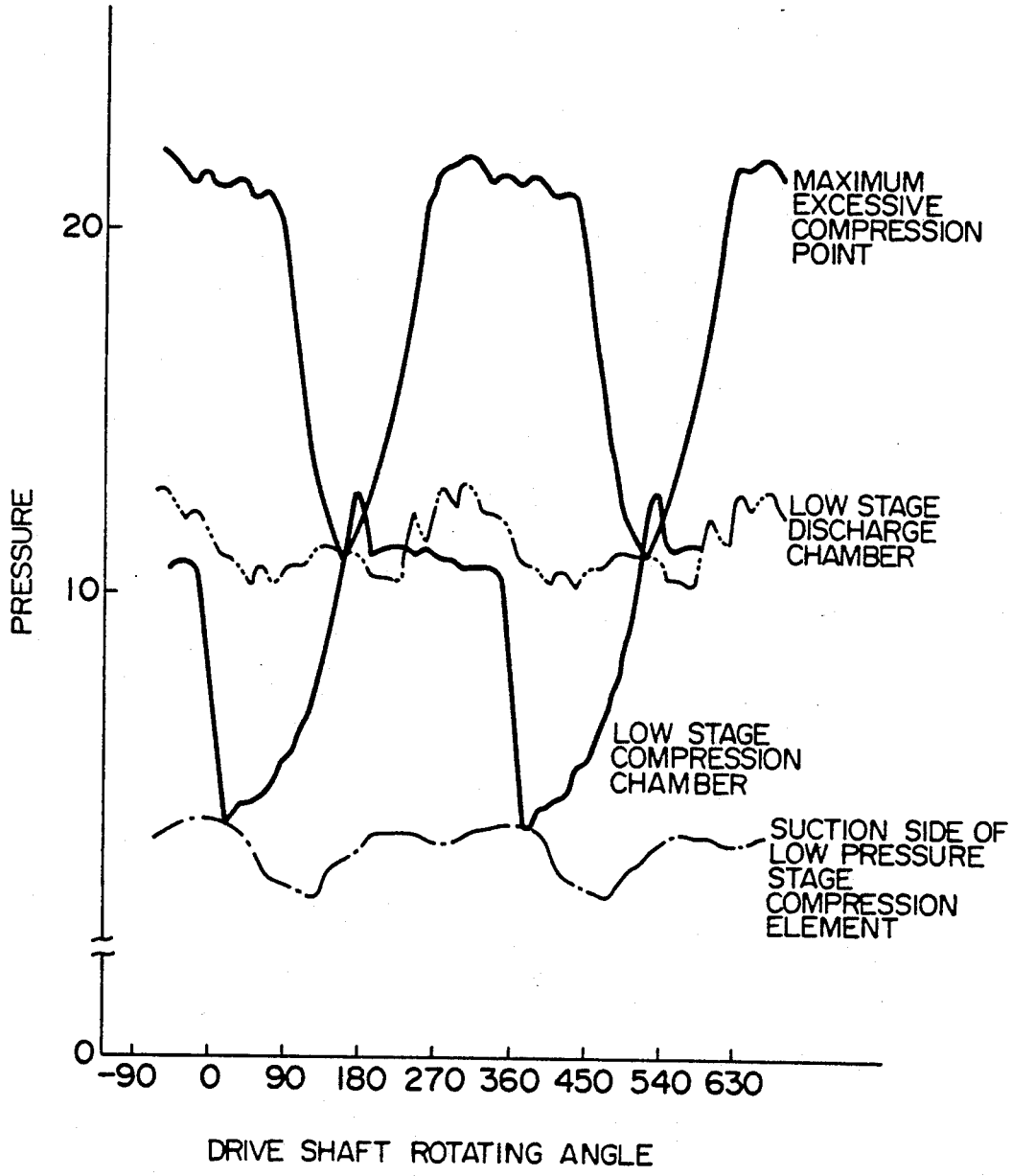
FIG. 12 PRIOR ART
FIG. 12 is a characteristic view showing pressure variations which are obtained by successively connecting pressures in the various parts shown in FIG. 11.
Figure 13:
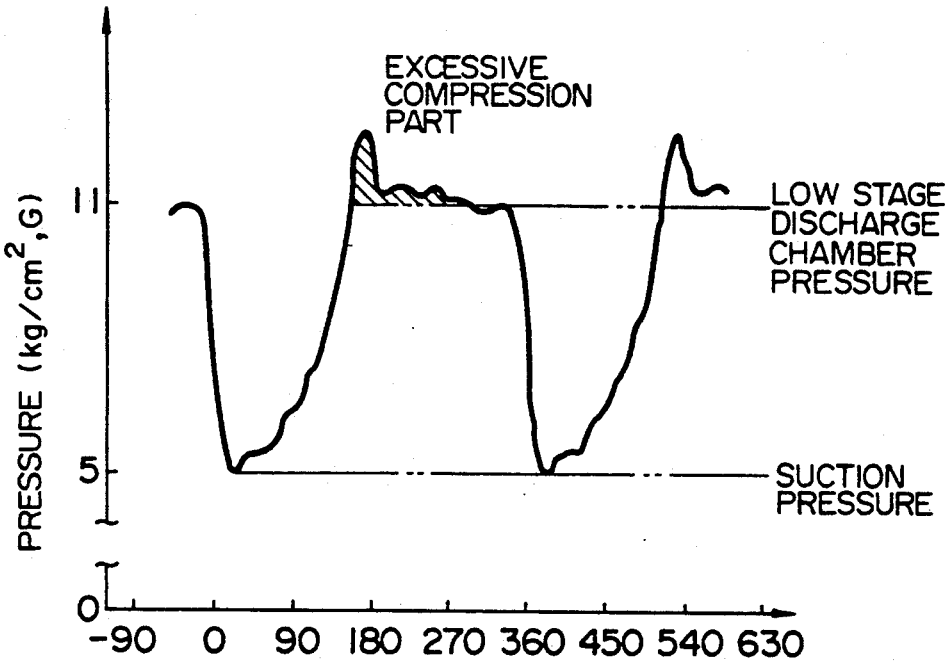
FIG. 13 PRIOR ART
FIG. 13 is a characteristic view showing a pressure variations which are extracted only from the pressure in a low stage compression chamber shown in FIG. 12.
Figure 14:
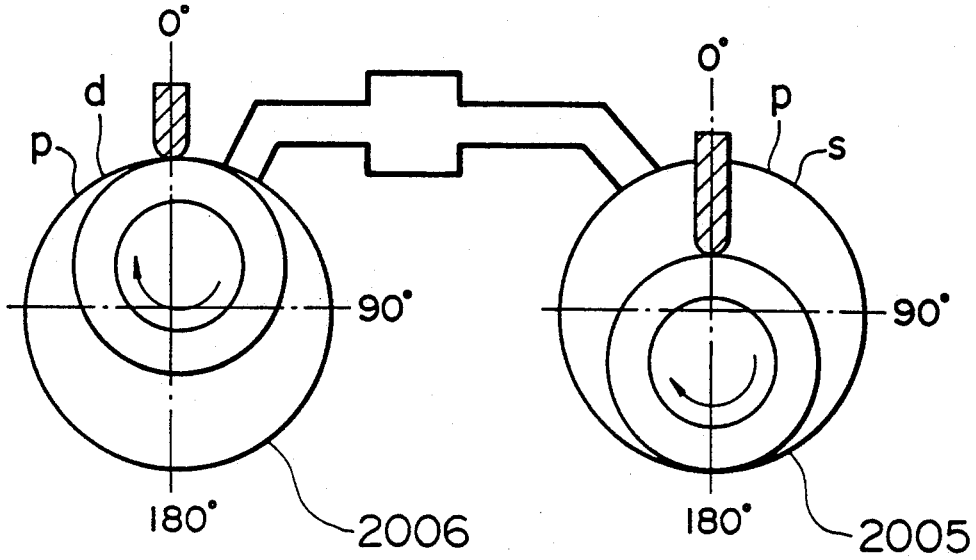
FIG. 14 PRIOR ART
FIG. 14 is an explanatory showing the compression timings of the low pressure stage compression element and the high pressure stage compression element of a conventional other second two stage coolant compressor.
Figure 15:
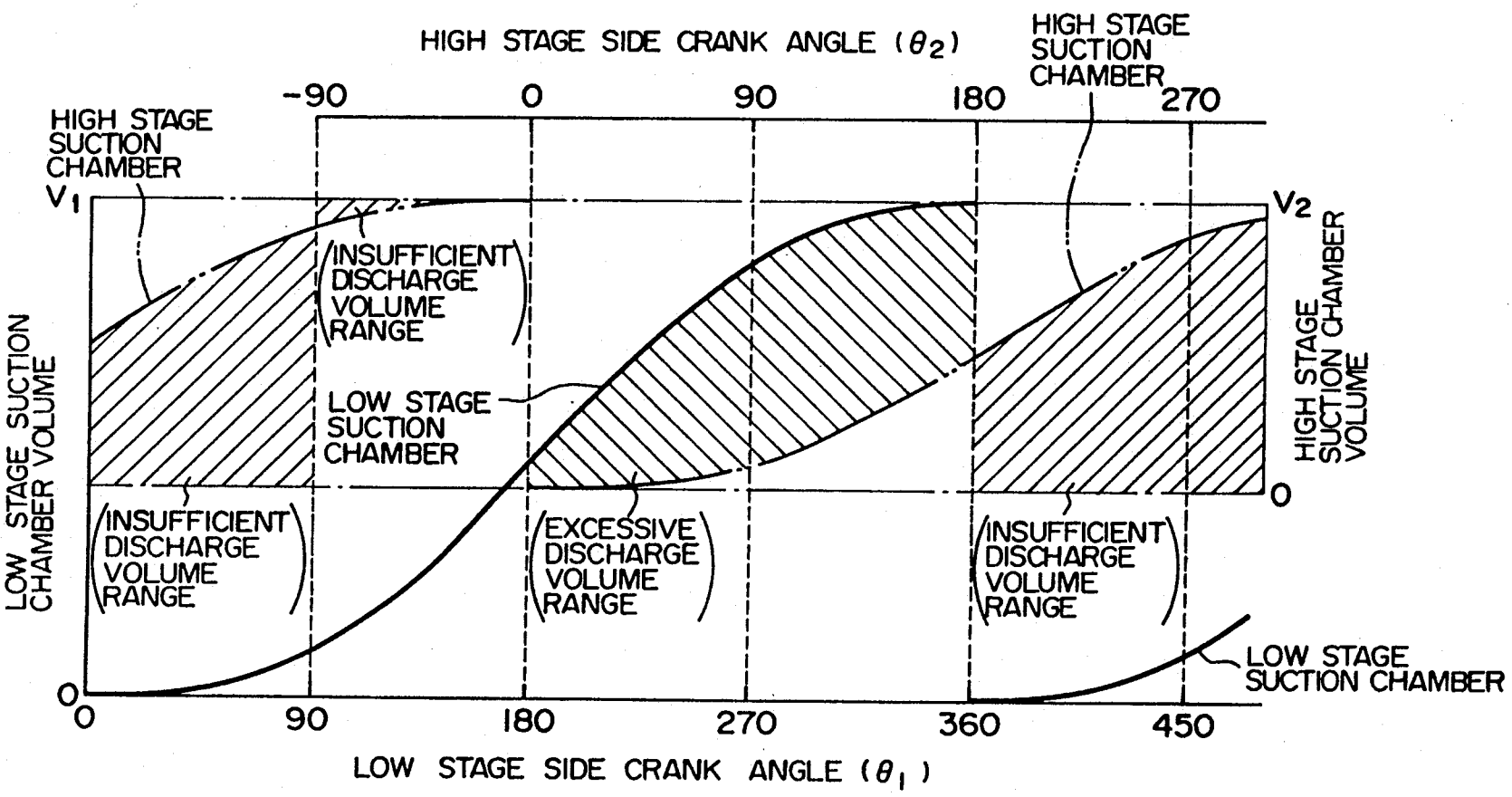
FIG. 15 PRIOR ART
FIG. 15 is an explanatory view showing excessive and insufficient conditions of the gas volume at the compression initiating timings of the compressor shown in FIG. 14.
Figure 16:
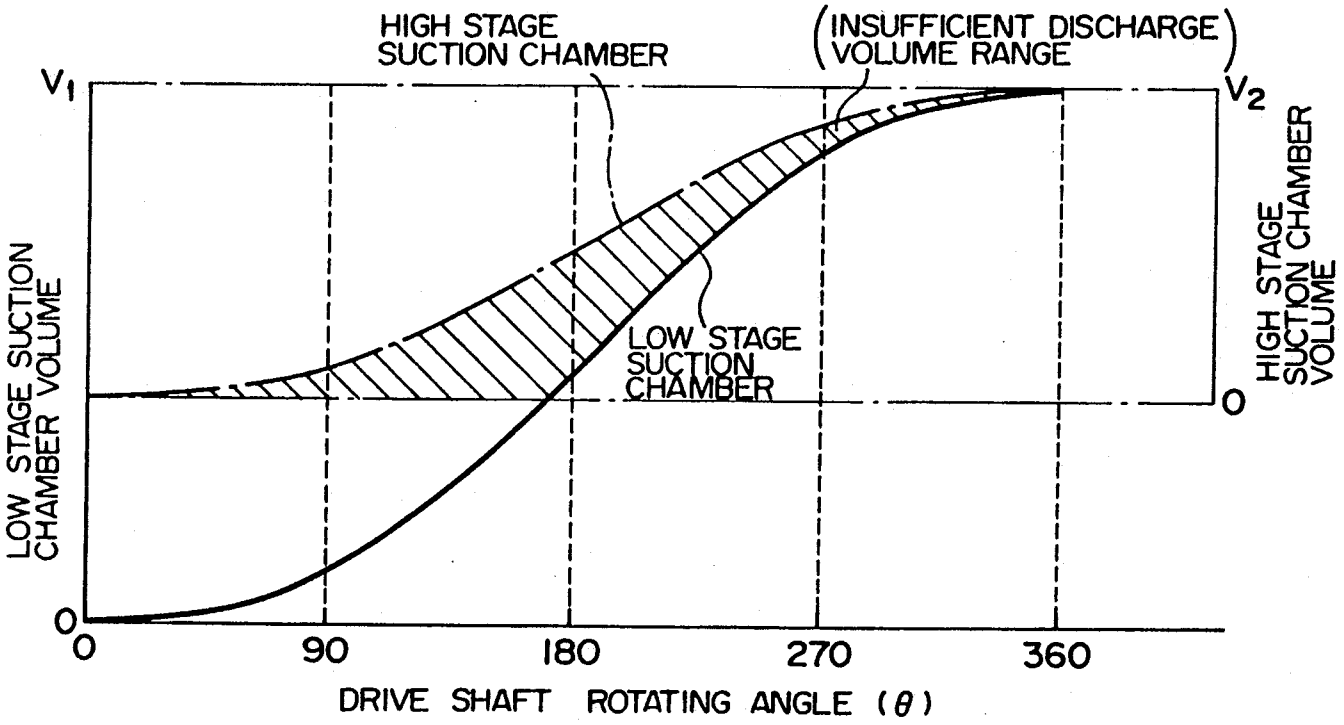
FIG. 16 PRIOR ART
FIG. 16 is an explanatory view showing excessive and insufficient conditions of gas volume at the compression timings of the low pressure stage compression element and the high pressure stage compression element of a conventional other third two stage coolant compressor.

Referring to FIGS. 17 to 25, when the drive shaft 6 is rotated by the motor 5, the low pressure stage compression element 7 always initiates suction so that gas flows into the suction chamber of the low pressure stage compression element 7 from the accumulator 2, as shown in FIG. 8. The volume of the low stage suction chamber increases as the crank angle advances while the compression is progressed simultaneously in the low stage compression chamber so as to gradually increase the pressure of compressed coolant gas.

The compressed coolant gas is discharged from a discharge port (which is not shown) formed in the lower bearing member 12 into the low stage discharge chamber 45 as the low stage side crank angle advances by about an angle of 170 deg. after initiation of the suction.

The coolant gas discharged into the low stage discharge chamber 45 counterflows into the rear chamber A44 by way of the oil return passage 49 composed of the oil return hole A49*a* and the oil return hole 49*b* together with lubrication oil pooled in the bottom part of the oil sump 46 in the discharge chamber so as to urge the rear surface of the vane 38 toward the first piston 7*b*.

Just after the start, coolant gas discharged into the low stage discharge chamber 45 is fed into the suction chamber 56 in the high pressure stage compression element 9 by way of the communication passage 55 composed of the gas passage A55*a*, the gas passage B55*b* and the gas passage C55*c*.

With a lag of 75 deg. from the initiation of the suction of the low pressure stage compression element 7, the high pressure stage compression element 9 initiates the suction and compression.

Just after the start, coolant gas in the low stage discharge chamber 45 and the communication passage 55 has a pressure which is higher than that of the condenser 13 or the gas-liquid separator 17 which are connected to the internal space of the closed container and the rolling piston type rotary two stage compressor 1 through pipe lines.

Accordingly, as shown in FIG. 23, a pressure differential between discharged coolant gas passing through the communication passage 55 and coolant gas in the gas-liquid separator 17 causes the valve element 60 to move so as to block the end part of the connection pipe 59 from the gas-liquid separator 17, and accordingly, the coolant injection passage 72 is closed so as to inhibit coolant gas in the communication passage 55 from counterflowing into the gas-liquid separator 17.

Further, the pressure of coolant gas in the communication passage 55 is higher than the pressure in the high stage discharge chamber 51 communicated with the internal space of the closed container 3 so that the valve element 58*a* in the bypass valve device 58 is moved toward the coil spring 58*b*, overcoming the urging force of the latter, so as to open the bypass passage 57, and accordingly, a part of coolant gas passing through the communication passage 55 flows into the high stage discharge chamber 51 while the pressure of coolant gas in the suction chamber 56 lowers. As a result, the vane 39 in the high pressure stage compression element 9, which depends upon only the urging force of the coil spring 41 is retracted, following a motion of the outer peripheral surface of the second piston 9*b* with no jumping phenomenon caused by the coolant gas having an increased pressure which abruptly flows into the suction chamber 56 so that the vane is abruptly retracted, and accordingly, smooth light load compression is initiated without occurrence of sound of bump between the vane 39 and the second piston 9*b*, and leakage of compressed gas.

It is noted that insufficiency and excess occur between the volume of coolant gas discharged into the low stage suction chamber 45 from the low pressure stage compression element 7 and the volume of the suction chamber of the high pressure stage compression element 9 since the suction and compression of the high pressure stage compression element 9 are initiated with a lag of 75 deg. from the initiation of the suction and compression of the low pressure stage compression element 7, and the excessive and insufficient volumes vary with the progress of the crank angle of the drive shaft 6. As a result, a range of crank angle in which the volume of coolant gas discharged into the low stage discharge chamber 45 is insufficient, and a range of crank angle in which the coolant gas is excessive are both present, and accordingly, pressure pulsation occurs in coolant gas in the low stage discharge chamber 45 and the communication passage 55. The higher the rotational speed of the drive shaft 6, the more the pressure pulsation tends to be excessive.

The condition of occurrence of the pressure pulsation is such that a crank angle around a point M (the discharge valve is opened so as to initiate discharge) at which the pressure of compressed coolant gas in the low stage discharge chamber 45 becomes maximum, coincides with a crank angle in a low pressure range of pressure pulsation in the low stage discharge chamber 45.

As a result, the pressure in the low stage discharge chamber 45 becomes lower upon initiation of discharge, and accordingly, excessive compression of compressed coolant gas in the low stage discharge chamber becomes less.

It is noted that the pressure pulsation in the low pressure range of the low stage discharge chamber 45 is successively induced by the low pressure pulsation range (point N) in the communication passage 55 which is caused by suction of the high pressure stage compression element 9, and the inducing timing is affected by a phase difference (60 to 80 deg.) of compression between the low pressure stage compression element 7 and the high pressure stage compression element 9 (refer to FIG. 25).

The discharged coolant gas discharged into the high stage discharge chamber 51 flows into a sound suppressing chamber 52 by way of the annular passage 53, and thereafter is fed into the internal space of the closed container 3 through the annular passage 54.

The check valve 60 is shifted toward the communication passage 55 by a pressure differential between discharged coolant gas passing through the communication passage 55 and the gas-liquid separator 17 so as to block the one end part of the communication passage 55 in order to prevent discharged coolant gas in the communication passage from counterflowing into the gas-liquid separator 17.

With the passage of time after a cold start of the compressor, the pressure in the motor chamber 8, and the condenser 13 and the gas-liquid separator 17 which are communicated with the motor chamber 8 increases so that the valve element 58*a* in the check valve device 58 in the bypass passage 57 is urged by the gas pressure in the high stage discharge chamber 51 and the coil spring 58*b* so as to close the bypass passage 57, and the valve element 60 having blocked the one end part of the communication passage 59 is shifted toward the communication passage 55 so as to communicate the gas-liquid separator 17 with the communication passage 55.

Further, lubrication oil in the oil sump 35 upon which the discharge pressure is applied, exerts a back pressure against the rear surface of the vane 39 in cooperation with the coil spring in the high pressure stage compression element 9, and flows by a small flow rate into the suction chamber 56 and the compression chamber through the slide surface gap while lubricating the slide surface of the vane 39. Further, the pressure of the lubrication oil is decreased through the intermediary of the downstream side passage B61*b* of the oil injection passage 61 having a constriction, and is then intermittently fed into the compression chamber so as to serves as a sealing oil film in the gap of the compression chamber and to lubricate the slide surface of the second piston 39.

The pressure of lubrication oil in the oil sump 35 is decreased down to a value substantially equal to the discharge pressure of the low pressure stage compression element 7 through the intermediary of the downstream side passage A61*a* of the oil injection passage 61 having the constriction, and thereafter, the opening of the downstream side passage A61*a* is opened to the rear chamber A44 so as to allow the lubrication oil to flow into the rear chamber A44 during a period from the time when the vane 38 in the low pressure stage compression element 7 is advanced toward the first piston 7*b* by about one-third to the time when it is again retracted by about one-third.

The lubrication oil having flown into the rear chamber 44, lubricates the slide surface of the vane 38, and flows into the low stage discharge chamber 45 by way of the oil return holes B49*b*, A49*a* so as to mix into discharged coolant gas. The thus obtained mixture flows into the suction chamber 56 in the high pressure stage compression element 9. The lubrication oil having flown into the suction chamber 56 in the high pressure stage compression element 9 merges into lubrication oil having flown into the suction chamber 56 through the rear chamber B43 and the downstream side passage 61*b* so as to serve to seal the gap in the compression chamber and to lubricate and cool the slide surface.

The lubrication oil in the oil sump 35 is fed to the bearing surfaces of the lower and upper bearing members 12, 11 supporting the drive shaft 6, and to the inner surfaces of the first and second pistons 7*b*, 9*b* by way of the shaft hole 62 and the radial hole 69 under viscous pumping action given by the spiral oil groove 64 formed on the outer surface of the drive shaft 6 and by the pump device 62 provided at the lower end of the drive shaft 6. The lubrication oil having been fed into the spiral oil groove 64*a* is discharged into the sound suppression chamber 52 from the top end of the upper bearing member 12 under the viscous pumping action, then is mixed into high pressure discharge gas compressed by two stages and discharged from the high discharge chamber 51, and is finally discharged into the motor chamber 8 through the annular passage 54.

The discharged coolant gas from which the lubrication oil is separated in the motor chamber 8 is fed into the refrigerating cycle on the outside of the compressor by way of the discharge pipe 7*e*.

The coolant gas is liquefied after passing through the condenser 13 and the first expansion valve 15, and is expanded up to a volume corresponding to the discharge pressure of the low pressure stage compression element 7 without evaporation. Thereafter, it flows into the gas-liquid separator 17 so as to allow gas-liquid separation, and as a result, liquefied coolant is collected in the bottom part of the gas-liquid separator 17.

Then, the unevaporated coolant gas flows into the communication passage 55 in the rolling piston type rotary two stage compressor 1 by way of the communication passage 59 opened to the upper space of the gas-liquid separator 17, then merges into discharge coolant gas from the low pressure stage compression element 7 so as to lower the temperature of the discharge gas on the low stage compression side, and flows into the suction chamber 56 in the high pressure stage compression element 9.

The two stage-compressed discharge coolant gas from the high pressure stage compression element 9 sucks thereinto unevaporated coolant gas from the gas-liquid separator 17 so as to be restrained from abnormally increasing its temperature, and as a result, it is possible to prevent the temperature of the motor 5 from abnormally increasing.

Meanwhile, liquefied coolant collected in the bottom part of the gas-liquid separator 17 circulates from the liquid pipe 65 successively through the second expansion valve 19 and the evaporator 21, and is then returned into the accumulator 2 after being subjected to second expansion and heat-absorption.

It is noted that the coolant in the gas-liquid separator 17 is heat-insulated and sound-shielded by the foamed polyethylene material surrounding the outer peripheral part of the barrel of the gas-liquid separator 17, and accordingly, it is possible to prevent sound of bump between the coolant and the inner surface of the gas-liquid separator 17 upon inflow of the coolant into the gas-liquid separator 17 from being externally transmitted, and to reduce the heat absorption by the coolant.

Next, explanation will be made of the operation of the second embodiment with reference to FIG. 26.

Coolant gas having flown into the first accumulator 202 under the operation of the two stage compressor, flows into the suction chamber in the low pressure stage compression element 7 by way of the suction pipe 202*a* while its cyclic pressure pulsation is restrained, and after being compressed, is successively fed into the suction side of the high pressure stage compression element 209. Since the supercharging action of the first accumulator 202 is restrained, the volume of suction gas into the low pressure stage compression element 207 per revolution of the first drive shaft 6 does not vary substantially even though the operating speed of the compressor varies, and therefore, the low stage discharge gas is fed out at a substantially uniform rate, with respect to the cylinder volume of the high pressure stage compression element 209. As a result, the pressure of the low stage discharge gas is maintained to be substantially constant without being abnormally increased, even though the operating speed of the compressor varies, thereby it is possible to reduce excessive compression in the compression chamber in the low pressure stage compression element 207.

The unevaporated coolant having flown into the second accumulator 202*b* from the gas-liquid separator (which is not shown) flows into the suction side of the high pressure stage compression element 209 by way of the valve element 207 together with the low stage discharge gas.

Meanwhile, the low stage discharge coolant gas discharged into the low stage discharge chamber 245 having a small internal volume is diffused without separating lubrication oil therefrom, and then involves lubrication oil flowing into the adjacent rear chamber A244 from the oil sump 35 through the oil injection passage 261 so as to lubricate the slide surface of the rear chamber A244, and thereafter, is fed into the high pressure stage compression element 209.

After the operation of the compressor is stopped, the temperature of the coil spring 270 lowers so as to increase its spring constant, resulting in a shift of the valve element 206 toward the second accumulator 202*b* so as to block the passage thereto, and accordingly, during rest of the compressor, it is possible to prevent liquid coolant from flowing into the communication passage 255 by way of the second accumulator 202*b*.

The operation other than that mentioned above, is similar to that in the first embodiment, and accordingly, explanation thereof will be abbreviated.

As mentioned above, according to the above-mentioned embodiment, the motor 5 and the low and high pressure stage compression elements 7, 9 driven by the motor 5 are disposed in the closed container 3 in order to constitute a rolling piston type rotary two stage compression mechanism in which the discharge side of the low pressure stage compression element 7 is communicated with the suction side of the high pressure stage compression element 9 through the intermediary of the communication passage 55 so that gas compressed by the high pressure stage compression element 9 is discharged into the closed container 3, defining the discharge gas passage for cooling the motor 5, and further the cylinder volume of the high pressure stage compression element 9 is set to 45 to 65% of the cylinder volume of the low pressure stage compression element 7 while the eccentric directions of the crank parts of the drive shaft 6 coupled to the motor 5, which crank parts are respectively engaged with the both compression elements, are shifted from each other by an angle of 180 deg. so as to delay the compression timing of the high pressure stage compression element 9 by an angle of 75 deg. from that of the low pressure stage compression element 7. Since the both compression elements 7, 9 are arranged as mentioned above, when coolant gas sucked into the cylinder in the low stage compression element 7 in association with the rotation of the motor 5 is compressed so as to reduce its volume down to 45 to 65% within the cylinder, the discharge valve initiates opening, and accordingly, the gas is gradually discharged into the low stage discharge chamber 45 in the low pressure stage compression element 7, and thereafter, the coolant gas is sucked into the cylinder in the high pressure stage compression element 9 having a cylinder volume of 45 to 65% of that of the low pressure stage compression element 7, by way of the communication passage 55. Then, the coolant gas is further compressed in the cylinder so as to boost the pressure up to a predetermined value, and is then discharged into the motor chamber 8 before it is fed out, externally of the compressor. However, due to a difference between the pressure boost-up speed of the compressed coolant gas in the low pressure stage compression element 7 and the suction speed thereof in the high pressure stage compression element 9, insufficiency or excess occurs between the volume of gas discharged into the low stage discharge chamber from the low pressure stage compression element 7 and the volume of the suction chamber in the high pressure stage compression element 9, and further, the excessive and insufficient volumes of the coolant gas varies with the advance of the crank angle of the drive shaft 6. Accordingly, since there are presented a crank angle range in which the volume of coolant gas discharged into the low stage discharge chamber 45 from the low pressure stage compression element 7 is insufficient and a crank angle range in which it is excessive, the suction of the high pressure stage compression element 9 is initiated with a delay of 75 deg. in compression phase, from the initiation of compression by the low pressure stage compression element 7 when pressure pulsation occurs in coolant gas in the low stage discharge chamber 45 and in the communication passage 55, and accordingly, the time of pressure pulsation in the low stage discharge chamber 45 in a low pressure range can be coincident with the time of discharge of compressed coolant gas from the cylinder in the low pressure stage compression element 7 so that the excessive compression of compressed coolant gas in the compression chamber is decreased, thereby it is possible to reduce the compression input.

Although it has been explained in the above-mentioned embodiments that the time of initiation of compression in the high pressure stage compression element is delayed by an angle of 75 deg. from the time of initiation of compression by the low pressure stage compression element 7, similar technical effects and advantages can be obtained even though the initiation of compression of the high pressure stage compression element 9 is delayed by an angle of 60 to 80.

Further, although coolant gas compressed by the high pressure stage compression element 9 is discharged directly into the motor chamber 8 in the above-mentioned embodiment, there may be provided a pipe line circuit such that coolant gas compressed in the high pressure stage compression element 9 is led directly outside of the closed container 3 so as to bypass the closed container 3 in order to be cooled, and is then led into the closed container 3 in order to cool the motor 5 before it is again discharged externally.

INDUSTRIAL USABILITY

As clearly understood from the above-mentioned embodiments, according to the present invention, the motor and the low and high pressure stage compression elements driven by the motor are disposed in the closed container in order to constitute a rolling piston type rotary two stage compression mechanism in which the discharge side of the low pressure stage compression element is communicated, in series, with the suction side of the high pressure stage compression element through the intermediary of the communication passage so that gas compressed by the high pressure stage compression element is discharged into the closed container, defining the discharge gas passage for cooling the motor, and further the cylinder volume of the high pressure stage compression element is set to 45 to 65% of the cylinder volume of the low pressure stage compression element while the compression timing of the high pressure stage compression element is delayed by an angle of 60 to 80 deg. from that of the low pressure stage compression element. Since the both compression elements are arranged as mentioned above, due to a difference between the pressure boost-up speed of the compressed coolant gas in the low pressure stage compression element and the suction speed thereof in the high pressure stage compression element, insufficiency or excess occurs between the volume of gas discharged into the low stage discharge chamber from the low pressure stage compression element and the volume of the suction chamber in the high pressure stage compression element, and further, the excessive and insufficient volumes of the coolant gas varies with the advance of the crank angle of the drive shaft coupled to the motor. Accordingly, since there are presented a crank angle range in which the volume of coolant gas discharged into the communication passage from the low pressure stage compression element is insufficient and a crank angle range in which it is excessive, pressure pulsation occurs in the in the communication passage. However, the time of pressure pulsation in the low stage discharge chamber in a low pressure range can be coincident with the time of discharge of compressed coolant gas from the cylinder in the low pressure stage compression element, and accordingly, the excessive compression of compressed coolant gas in the compression chamber is decreased, thereby it is possible to reduce the compression input.

What is claimed is:

1. A rolling piston type rotary two stage coolant compressor comprising:

a closed container; and a two stage compression mechanism disposed in said closed container and composed of a motor, a high and a high pressure stage compressor element which are driven by said motor, said high pressure stage compression element having a discharge side and said high pressure stage compression element having a suction side and said discharge side is communicated with said suction side in series by way of a communication passage while coolant compressed by said high pressure stage compression element is discharged into said closed container so as to define a discharge gas passage for cooling said motor, further said high pressure stage compression element having a cylinder volume which is set to 45 to 65% of that of said low pressure stage compression element while said high pressure stage compression element has a compression timing which is delayed by an angle of 60 to 80 deg. from that of said low pressure stage compression element.

* * * * *